US007565085B2

(12) United States Patent
Okuyama et al.

(10) Patent No.: US 7,565,085 B2
(45) Date of Patent: Jul. 21, 2009

(54) IMAGE FORMING DEVICE AND TONER CONSUMPTION AMOUNT ESTIMATING METHOD

(75) Inventors: Masahiro Okuyama, Yamatokoriyama (JP); Shinji Imagawa, Ikoma-gun (JP); Hiroshi Kawano, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 381 days.

(21) Appl. No.: 11/298,745

(22) Filed: Dec. 12, 2005

(65) Prior Publication Data

US 2006/0127108 A1 Jun. 15, 2006

(30) Foreign Application Priority Data

Dec. 14, 2004 (JP) ..... 2004-361895

(51) Int. Cl.
*G03G 15/08* (2006.01)

(52) U.S. Cl. ..... 399/27; 399/28; 399/49; 399/53; 399/60; 399/61

(58) Field of Classification Search ..... 399/27, 399/28, 49, 53, 60, 61
See application file for complete search history.

(56) References Cited

U.S. PATENT DOCUMENTS

| | | | | |
|---|---|---|---|---|
| 5,794,094 | A * | 8/1998 | Boockholdt et al. | 399/27 |
| 6,456,802 | B1 * | 9/2002 | Phillips | 399/27 |
| 6,510,292 | B1 * | 1/2003 | Owen et al. | 399/27 |
| 6,792,216 | B2 * | 9/2004 | Wachter et al. | 399/27 |
| 2003/0133722 | A1 * | 7/2003 | Kaiho | 399/27 |
| 2004/0174404 | A1 * | 9/2004 | Itagaki | 347/15 |
| 2004/0247330 | A1 | 12/2004 | Kim | |
| 2006/0127109 | A1 * | 6/2006 | Itoyama et al. | 399/27 |

FOREIGN PATENT DOCUMENTS

| | | |
|---|---|---|
| JP | 05-027594 | 5/1993 |
| JP | 08-320613 | 3/1996 |
| JP | 2002-178607 | 6/2002 |
| JP | 2002-287499 | 10/2002 |
| JP | 2003-076231 | 3/2003 |
| JP | 2003-122205 | 4/2003 |
| JP | 2003-122205 A | 4/2003 |
| JP | 2004-294761 | 10/2004 |
| JP | 2004-294761 A | 10/2004 |

* cited by examiner

*Primary Examiner*—David M Gray
*Assistant Examiner*—Ryan D Walsh
(74) *Attorney, Agent, or Firm*—Nixon & Vanderhye P.C.

(57) ABSTRACT

An image forming apparatus includes: toner supply amount detecting means for detecting a toner supply amount to a developer tank; detecting means for detecting a signal value of each pixel of an image; and toner consumption amount estimating means for estimating a toner consumption amount, based on the signal value. The signal value detected by the detecting means is corrected in accordance with the toner supply amount detected by the toner supply amount detecting means. The toner consumption amount is estimated based on the signal value corrected. This allows the toner consumption amount to be always calculated accurately, regardless of a variation amongst various models, or a variation in a toner consumption characteristic due to aging, using environment, or the like.

20 Claims, 24 Drawing Sheets

IMAGE FORMING DEVICE AND TONER CONSUMPTION AMOUNT ESTIMATING METHOD

This Nonprovisional application claims priority under 35 U.S.C. § 119(a) on Patent Application No. 2004/361895 filed in Japan on Dec. 14, 2004, the entire contents of which are hereby incorporated by reference.

FIELD OF THE INVENTION

The present invention relates to an image forming apparatus which digitally carries out an image processing and a correction process with respect to image information, the image forming apparatus such as a copy machine, a laser beam printer, and a facsimile device, each of which adopting an electro photographic system.

BACKGROUND OF THE INVENTION

Generally, in an electrophotographic device such as a digital copying machine, a digital image signal, an image processing is carried out as follows, with respect to a digital image signal which is inputted from an input device such as a scanner. Namely, the digital image signal is outputted as an output image signal, after the digital image signal is: (I) subjected to digital-signal processing such as an input signal processing, a segmentation process, a color correction process, a black-generation process, and a zoom scaling process; and (II) further subjected to a filtration process using a spatial filter, and a halftone correction process.

FIG. 20 is a control block diagram illustrating the image processing of a conventional digital copying machine. The conventional digital copying machine includes: an input signal processing section 210; a segmentation process section 220; a color-correction/black-generation process section 230; a zoom scaling process section 240; a spatial filtration process section 250; a halftone correction process section 260; a pixel count section 270; and a toner consumption amount estimating section 280.

The following describes an image processing carried out in such a digital copying machine, with reference to FIG. 21.

First, an input digital-image signal of a document read in with a use of a scanner or the like is inputted to the input signal processing section 210, and is subjected to a pre-process for the subsequent image processing, and an image adjustment process such as an input-gamma correction and a conversion process (S201 and S202).

Next, the image signal is inputted to the segmentation process section 220, and a region-judgment is carried out for judging whether the image belongs to a character region, a halftone photographic region, or the like. Then, for each region thus judged, an identification signal (region identification signal) which indicates the type of each region is outputted(S203). The region identification signal is used in a subsequent process performed in the spatial filtration process section 250 or the halftone correction process section 260, in accordance with the type of region. For example, in the case of a halftone region, the region identification signal is used to carry out a smoothing-filtration process. In the case of the character region, the region identification signal is used to carry out an edge enhancement filtration process, or to change the halftone gamma characteristics to characteristics that shows a difference between a thick color and a light color more clearly.

A color-correction/black-generation process (Step: S204) to be carried out next, in the color-correction/black-generation process section 230, is a process which is necessitated in a case where the device is a color image forming apparatus. In the color-correction/black-generation process section 230, an RGB-image-signal having been transmitted from the segmentation process section 220 is converted into a CMYK (Cyan, Magenta, Yellow, Black)-image signal which is the final outputting format.

The image signal having converted into the CMYK-image signal is subjected to the zoom scaling process carried out in the zoom scaling process section 240 (S205), and then is inputted to the spatial filtration process section 250. In the spatial filtration process section 250, a suitable spatial filter is selected from a spatial filter table, in accordance with the region identification signal, a setting of an image mode, or the like. Then, by using the selected spatial filter, the spatial filtration process is carried out with respect to the CMYK-image-signal (S206). The spatial filter table is a table groups of filter coefficient, and is used as a reference at the time of the spatial filtration process. The table groups are selectively used in accordance with the circumstance.

Next, in the halftone correction process section 260, the halftone gamma property is corrected for a purpose of correcting a property of an output from an engine section (S207).

Further, the image signal subjected to the halftone correction process is inputted to a pixel count section 270, and then an accumulation process is carried out by using a counter while carrying out, on a pixel-to-pixel basis, a weighting process with respect to each signal of C, M, Y, and K (S208). After that, the output image signal is transmitted to an LSU, or an engine output-end of an LED (S210). In the toner consumption amount estimating section 280, a toner consumption amount is calculated for each color of C, M, Y, and K, based on an accumulated value obtained from the pixel count process (S209). The toner consumption amount thus calculated is for use in: a toner near-end judgment, accumulation of toner consumption amount data, or the like.

Further, on an engine-side of the digital copying machine, the following control is carried out, in order to restrain an aging-caused variation in, for example, a photoreceptor or a developer. Namely, a process condition is controlled, so as to achieve a constant toner density and/or a constant image output, since the first time operation of the copy machine until the end of its life. The process condition which is controlled is, for example, an exposure amount, an amount of toner density correction, and a developing bias value, or the like.

FIG. 22 is a flowchart providing a simple illustration of a toner density control process which is one of control processes carried out on the engine-side. In the toner density control process, a control value of a toner density sensor is determined based on a value of a life counter, a value of an environment sensor, or the like (S211, S212). An on/off operation of toner supply is controlled in accordance with this control value. In short, when the toner density is low (if resulting in "Yes" in S213), the toner supply is turned on so as to supply the toner (S214). Thus, a constant toner density is maintained.

Further, FIG. 23 is a flowchart providing a simple illustration of the halftone gamma correction process using a toner patch. In the halftone gamma correction process, a toner patch is formed, by using a halftone pattern (tones), on a photoreceptor or on a transfer belt (S221 to S223). This halftone pattern is obtained from a predetermined fixed input value. Then, an optical sensor or the like is used for reading an amount of light reflected from the toner patch (S224). Next, a sensor output value obtained from the read amount of reflection light is compared with a targeted value serving as a reference value, so as to calculate the correction amount (S225). In accordance with thus calculated correction amount, the current halftone gamma correction table is corrected (S226). This realizes a halftone gamma property which is always constant.

Next described in detail is how to calculate the toner consumption amount. Note that the following process is carried out on a color-by-color basis with respect to the colors of C, M, Y, and K (i.e., the process is carried out for each input signal of C, M, Y, and K).

The pixel count section 270 carries out, with respect to an input multi-valued image, the pixel count process as described below. As illustrated in FIG. 20, the pixel count section 270 includes: counting means 271; weighting calculation means 272; a weighting coefficient table 273; accumulating means 274.

The counting means 271 counts an input signal value of the inputted multi-value image (e.g. a multi tone image expressed in, for example, 16 tones or 256 tones) for each pixel. That is, the counting means 271 counts the input value (tone) of each pixel constituting the inputted multi-value image. For example, an input value which ranges from 0 to 15 is counted in the case of 16 tones.

The weighting calculation means 272 carries out the weighting process on the pixel-by-pixel basis, at the time the counting process is carried out by the counting means 271. More specifically, the weighting calculation means 272 acquires a weighting coefficient, corresponding to the input signal value of each pixel, from a weighting coefficient table 273, and multiplies the input signal value by the weighting coefficient so acquired. The weighting coefficient table 273 stores weighting coefficients respectively corresponding to input values of the pixels and used in the weighting process carried out by the weighting calculation means 272. As described, in the pixel count section 270, the pixel count process is carried out on the pixel-by-pixel basis, by using the counting means 271, the weighting calculation means 272, and the weighting coefficient table 273.

Then, the accumulating means 274 accumulates values of the respective pixels resulted from the pixel count process. More specifically, the weighting calculation means 272 multiplies the input signal value of each pixel by the weighting coefficient, and the accumulating means 274 accumulates the calculated values for all the pixels constituting the multi value image which has being inputted. Based on the accumulated value of the pixels calculated by the pixel count section 270, the toner consumption amount estimating section 280 estimates a toner consumption amount needed for the output image. The weighting coefficients stored in the weighting coefficient table 273 are values determined in advance. Table 1 below indicates an example of the weighting coefficient table 273, where the input signal value ranges from 0 to 15 in 16 values.

TABLE 1

| | Weighting Coefficient (Fixed) | |
|---|---|---|
| | INPUT SIGNAL VALUE | WEIGHTING COEFFICIENT |
| AREA 1 | 0-4 | 0 |
| AREA 2 | 5-8 | 1 |
| AREA 3 | 9-12 | 3 |
| AREA 4 | 13-15 | 4 |

In the case of Table 1, the input signal values are classified into 4 areas (area 1 to area 4) in accordance with the toner consumption amount. The weighting coefficient is determined for each of these areas. In the pixel-count process, the weighting process is carried out by selectively using, in accordance with the input signal values of 0 to 15, the weighting coefficients of the four areas.

FIG. 24 illustrates a relationship between the input signal values classified into the four areas of the weighting coefficient table of Table 1, and the weighting coefficients respectively associated with the input signal values. As illustrated in FIG. 24, a total area of the rectangles is substantially the same as an area below a curve indicating the toner consumption amount. Accordingly, it is possible to estimate the toner consumption amount from the total of the pixel-count values accumulated after the weighting process.

Japanese Unexamined Patent Publication No. 2002-287499 (Tokukai 2002-287499; published on Oct. 3, 2002) discloses an image forming apparatus which effectively prevents a variation in thin-toner layer, when continuously copying an image whose toner-consumption rate is extremely small. More specifically, the above publication discloses the image forming apparatus including: a pixel counter; a copy counter; and toner consuming means. This image forming apparatus forcedly executes a toner patch creating process when a less number of pixels than a predetermined value is counted, while a predetermined number of records are counted.

However, the conventional image forming apparatus such as a digital copying machine adopting the electro photographic system had the following problem.

Namely, as described above, when the toner consumption amount needed for the output image is calculated by carrying out the pixel-count process, storage means has been used as the weighting coefficient table, for storing the pre-fixed weighting coefficients. However, if such a weighting coefficient table is used, the weighting coefficient selected, from weighting coefficient table, for one input signal value may differ from a value on the curve indicating the toner consumption amount for the same input signal value, as illustrated in FIG. 24. Accordingly, the toner consumption amount may not be accurately calculated from the total value of the pixel values obtained from the weighting process.

In this case, for example, it is possible to reduce the difference between the actual toner consumption amount and the toner consumption amount estimated based on the pixel-count value, by using a weighting coefficient table, which stores the weighting coefficients respectively corresponding to each of the input signal values (i.e., each tone of the respective input signal), as illustrated in FIG. 25.

However, as indicated by a curve D (solid line) and a curve E (broken line) of FIG. 25, the toner consumption characteristic may vary amongst various models, or vary due to the aging or the like. Accordingly, by merely using the weighting coefficient table storing the weighting coefficients respectively corresponding to the tones of the input signal, it is not possible to follow the variation in the toner consumption characteristic amongst various models, or the variation in the toner consumption characteristic due to aging. As such, the difference between the actual toner consumption amount and the toner consumption amount estimated based on the pixel-count value cannot be reduced. This causes a problems that the toner consumption amount is not accurately estimated.

SUMMARY OF THE INVENTION

An object of the present invention is to provide an image forming apparatus and a toner consumption amount estimating method which allow a toner consumption amount to be estimated as accurately as possible, regardless of a variation in a toner consumption characteristic amongst various models, or an aging-caused variation in the toner consumption characteristic.

An image forming apparatus of the present invention is an image forming apparatus which forms, in accordance with an input signal, an image by using toner supplied to a developer tank, the image forming apparatus comprising: toner supply amount detecting means for detecting a toner supply amount to the developer tank; detecting means for detecting a signal value of each pixel of the image; correcting means for correcting, in accordance with the toner supply amount, the signal value detected by the detecting means, the toner supply amount detected by the toner supply amount measuring section; and toner consumption amount estimating means for estimating a toner consumption amount, based on the signal value corrected by the correcting means.

A method of the present invention for estimating a toner consumption amount is a method for estimating a toner consumption amount in an image forming apparatus which forms, by using the toner supplied to a developer tank, an image in accordance with an input signal, the method comprising the steps of: detecting a toner supply amount to the developer tank; detecting a signal value of each pixel of the image; correcting, in accordance with the toner supply amount, the signal value detected; and estimating the toner consumption amount in the image forming apparatus, based on the signal value corrected.

The toner consumption characteristic varies amongst various models, or varies due to aging, using environment, or the like. Accordingly, estimation of the toner consumption amount based on the signal value of each pixel causes an error between the toner consumption amount estimated and the actual toner consumption amount. This error tends to become more significant, as the number of image forming operations performed in the image forming apparatus increases.

The toner supply amount to the developer tank is substantially equal to the toner consumption amount in the developer tank. By utilizing this fact, the signal value is corrected, in accordance with the amount of the supplied toner, and the toner consumption amount is estimated based on the corrected signal value. In this way, the configuration of the present invention allows an estimation of the toner consumption amount which is closer to the actual consumption amount, when compared to the case of estimating the toner consumption amount without the correction of the signal value in accordance with the toner supply amount.

Thus, the toner consumption amount can be estimated more accurately, even if the toner consumption characteristic varies amongst various models, or varies due to influence from aging, using-environment, or the like.

Additional objects, features, and strengths of the present invention will be made clear by the description below. Further, the advantages of the present invention will be evident from the following explanation in reference to the drawings.

DESCRIPTION OF THE EMBODIMENTS

The following describes an embodiment of the present invention with reference to attached drawings. Note that the following embodiment is a concrete example of the present invention, and a technical scope of the present invention is not limited to the following.

Figure 1:
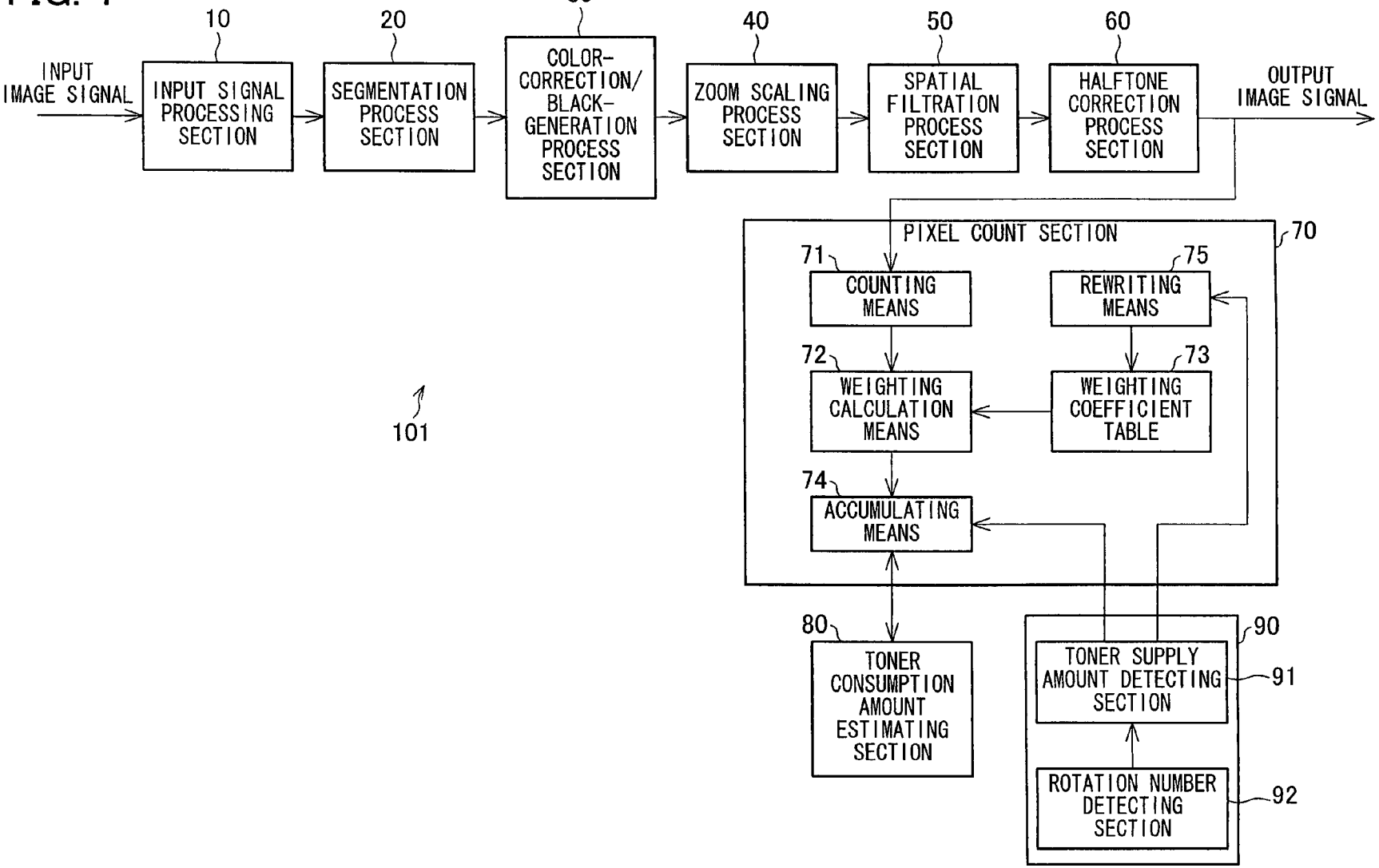
FIG. 1 is a block diagram illustrating a main part of an image forming apparatus in accordance with an embodiment of the present invention.

FIG. 1 is a functional block diagram illustrating an image processing section in an image forming apparatus (digital electrophotographic device) 101 of the present embodiment. As illustrated in FIG. 1, the image forming apparatus 101 includes an input signal processing section 10, a segmentation process section 20, a color-correction/black-generation process section 30, a zoom scaling process section 40, a spatial filtration process section 50, a halftone correction process section 60, a pixel count section (pixel value calculating means) 70, a toner consumption amount estimating section (toner consumption amount estimating means) 80, and a toner supply amount calculating section (toner supply amount calculating means) 90. From the image forming apparatus 101, an input digital-image signal representing an image which has been read in by using a scanner (not shown) or the like, is outputted as an output image signal, via the input signal processing section 10, the segmentation process section 20, the color-correction/black-generation process section 30, the zoom scaling process section 40, the spatial filtration process section 50, and the halftone correction process section 60.

The following describes an image processing carried out in the image forming apparatus 101 having such a configuration.

First, in the input signal processing section 10, an input digital-image signal obtained from a document that has been read in with the use of the scanner or the like is subjected to a pre-process for the subsequent image processing, and an image adjustment process such as an input-gamma correction and a conversion process.

In the segmentation process section 20, a region-judgment is carried out for judging whether the image belongs to a character region, a halftone photographic region, or the like. Then, for each region thus judged, an identification signal (region identification signal) which indicates the type of each region is outputted. The region identification signal is used in a subsequent process performed in the spatial filtration process section 50 or the halftone correction process section 60, in accordance with the type of region. For example, in the case of a halftone region, the region identification signal is used to carry out a smoothing-filtration process. In the case of the character region, the region identification signal is used to carry out an edge enhancement filtration process, or to change the halftone gamma characteristics to characteristics that shows a difference between a thick color and a light color more clearly.

In the color-correction/black-generation process section 30, an RGB-image-signal having been transmitted from the segmentation process section 220 is converted into a CMYK (Cyan, Magenta, Yellow, Black)-image signal which is the final outputting format. In the zoom scaling process section 40, a scaling process is carried out with respect to the CMYK image signal obtained by the conversion in the color-correction/black-generation process section 30.

In the spatial filtration process section 50, a suitable spatial filter is selected from a spatial filter table, in accordance with the region identification signal, a setting of an image mode, or the like. Then, by using the selected spatial filter, the spatial filtration process is carried out with respect to the CMYK-image-signal. In the halftone correction process section 60, a correction of halftone gamma property is carried out with respect to the image signal having been subjected to the spatial filtration process. Then, after the halftone correction process section 60 carries out the halftone correction process, the image signal having been subjected to the halftone correction process is outputted as the output image signal.

In the pixel count section 70, a pixel count process is carried out, on a pixel by pixel basis. In the pixel count process, a value of the CMYK-image-signal value is multiplied by a weighting coefficient based on the image signal having been subjected to the halftone correction process in the halftone correction process section 60. This pixel count section 70 is described later in detail.

In the toner consumption amount estimating section 80, a toner consumption amount is calculated for each color of C, M, Y, and K, based on an accumulated value obtained from the pixel count process.

Figure 14:
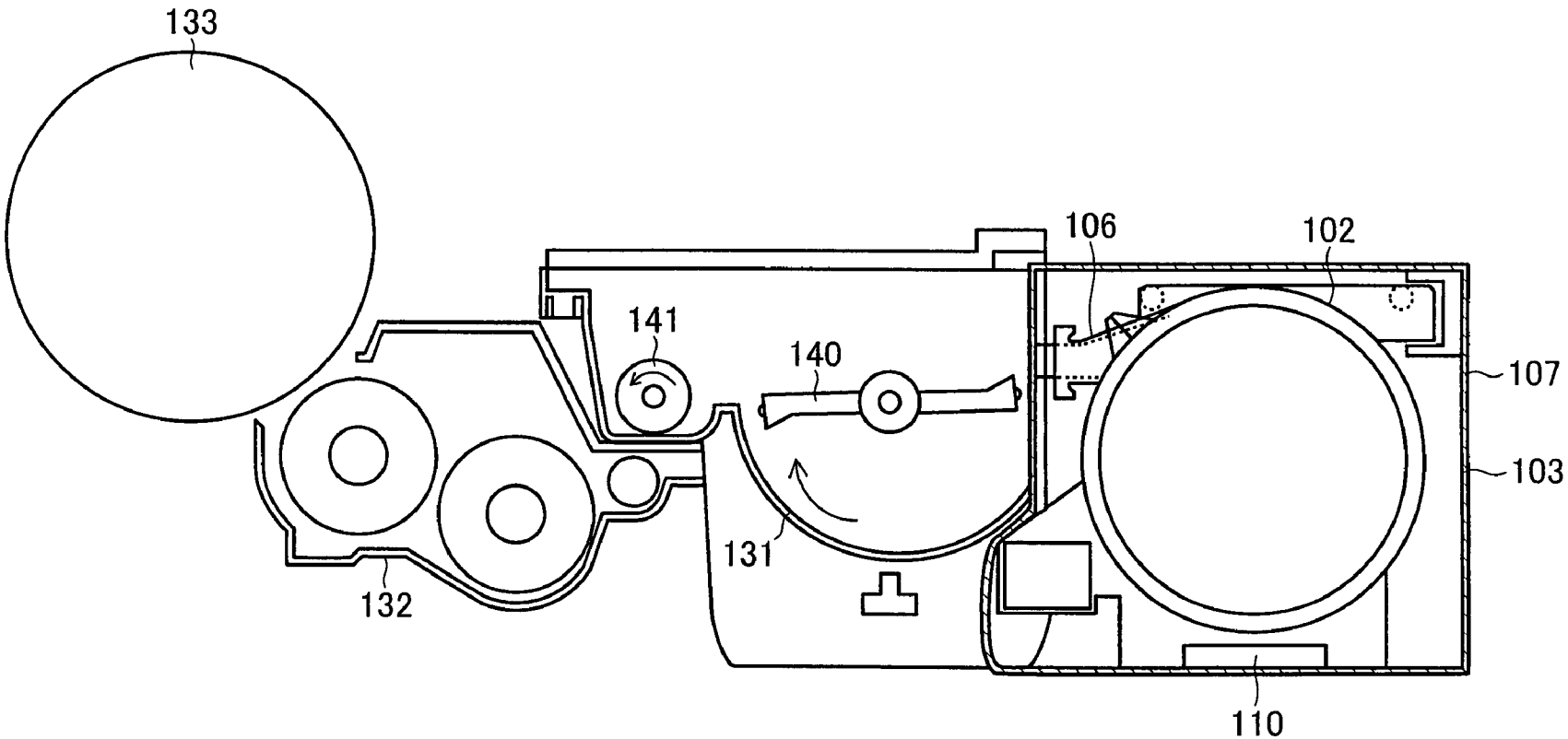
FIG. 14 is a cross sectional view of a main part of the image forming apparatus illustrated in FIG. 13.

As illustrated in FIG. 14, for example, in the toner supply amount calculating section 90, an amount of the toner supplied to a developing device 132 is calculated from the number of rotations of an agitator 140 which rotates in an intermediate hopper 131. The toner supply amount calculating section 90 is described later in detail.

The following describes in detail a process carried out for calculating the toner consumption amount in the image forming apparatus 101. Note that the following process is carried out on a color-by-color basis with respect to the colors of C, M, Y, and K (i.e., the process is carried out for each input signal of C, M, Y, and K).

The pixel count section 70 carries out, with respect to an input multi-valued image, the pixel count process as described below. As illustrated in FIG. 1, the pixel count section 70 includes: counting means 71; weighting calculation means 72; a weighting coefficient table 73; accumulating means 74; and rewriting means (pixel value correction means) 75.

The counting means (detecting means) 71 counts (detects) an input signal value of the inputted multi-value image (e.g. a multi tone image expressed in, for example, 16 tones or 256 tones) for each pixel. That is, the counting means 71 counts the input value (tone) of each pixel constituting the inputted multi-value image. For example, an input value which ranges from 0 to 15 is counted in the case of 16 tones.

The weighting calculation means 72 carries out the weighting process on the pixel-by-pixel basis, at the time the counting process is carried out by the counting means 71. More specifically, the weighting calculation means 72 acquires a weighting coefficient, corresponding to the input signal value of each pixel, from a weighting coefficient table 73, and multiplies the input signal value by the weighting coefficient so acquired. The weighting coefficient table 73 stores weighting coefficients respectively corresponding to input values of the pixels and used in the weighting process carried out by the weighting calculation means 72. As described, in the pixel count section 70, the pixel count process is carried out on the pixel-by-pixel basis, by using the counting means 71, the weighting calculation means 72, and the weighting coefficient table 73.

Then, the accumulating means 74 accumulates values of the respective pixels resulted from the pixel count process. More specifically, the weighting calculation means 72 multiplies the input signal value of each pixel by the weighting coefficient, and the accumulating means 74 accumulates the calculated values for all the pixels constituting the multi value image which has being inputted. Further, the accumulating means 74 accumulates the number of toner supply operations, based on toner supply amount information obtained from the toner supply amount calculating section 90 (described later).

The rewriting means (correcting means) 75 rewrites the weighting coefficient table 73 in accordance with the toner supply amount information obtained from the toner supply amount calculating section 90.

The toner consumption amount estimating section (toner consumption amount estimating means) 80 calculates an amount of toner consumed in printing the output image. This is performed based on the accumulated pixel value calculated by the pixel count section 70 (i.e., values accumulated by the accumulating means 74).

Figure 2:
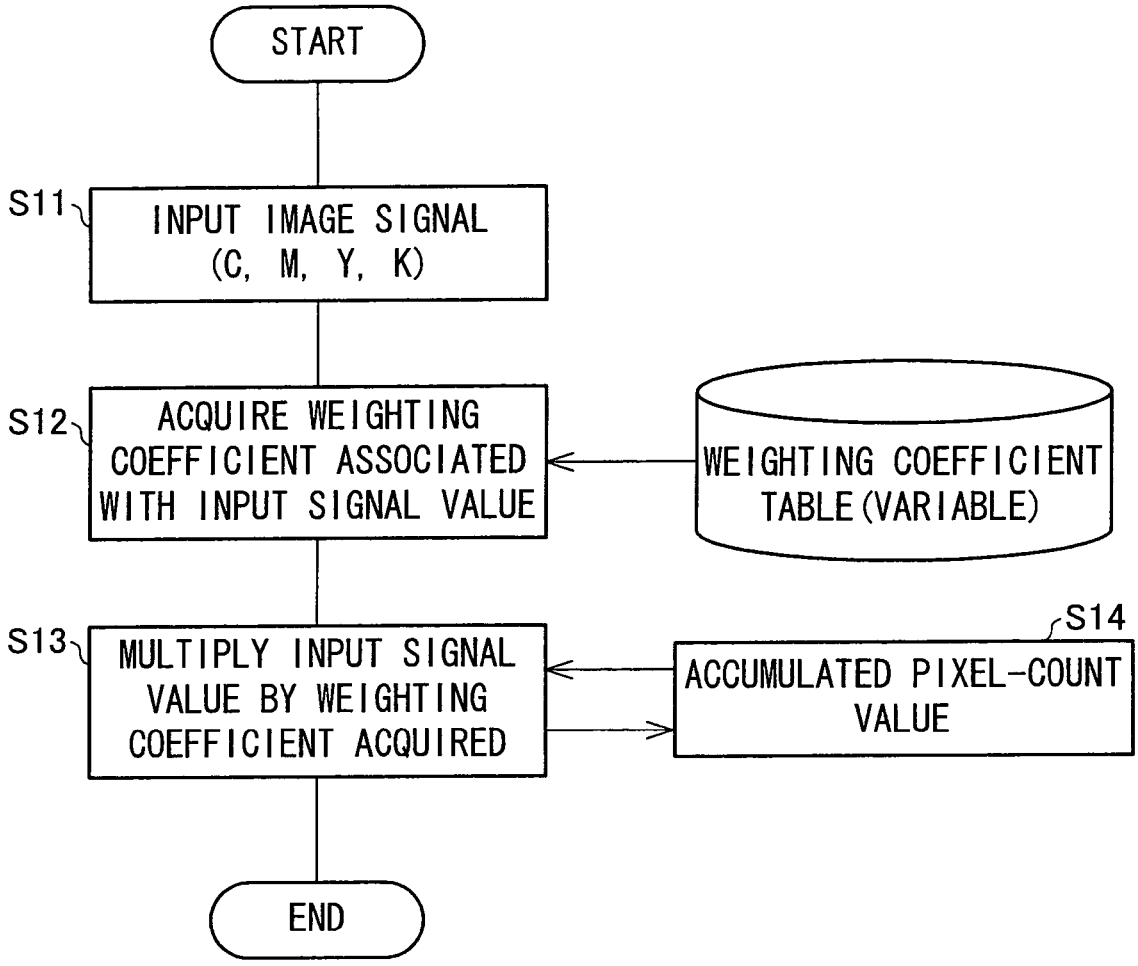
FIG. 2 illustrates the steps of a process executed in the image forming apparatus illustrated in FIG. 1, and is a flow chart illustrating the steps of estimating a toner consumption amount of one pixel.

The following describes, with reference to FIG. 2, how the amount of the toner consumed for one pixel, is calculated. As illustrated in FIG. 2, when a signal corresponding to one of the pixels constituting the multi-valued image is inputted to the pixel count section 70 (S11), the counting means 71 counts the input signal value. Next, the weighting calculation means 72 acquires, from the weighting coefficient table 73, a weighting coefficient corresponding to the input signal value (S12), and then the input signal value is multiplied by the acquired weighting coefficient (S13). Based on the calculated value (hereinafter, pixel-count value) of one pixel, the toner consumption amount estimating section 80 calculates the amount of toner consumed for the pixel. The pixel-count value in S13 is successively accumulated by the accumulating means 74, and is stored as an accumulated pixel-count value (S14). The accumulated pixel-count value is a total of pixel-count values of all the pixels of the inputted image. Based on the accumulated pixel-count value, the toner consumption amount estimating section 80 calculates the amount of the toner to be consumed for printing the output image.

Figure 3:
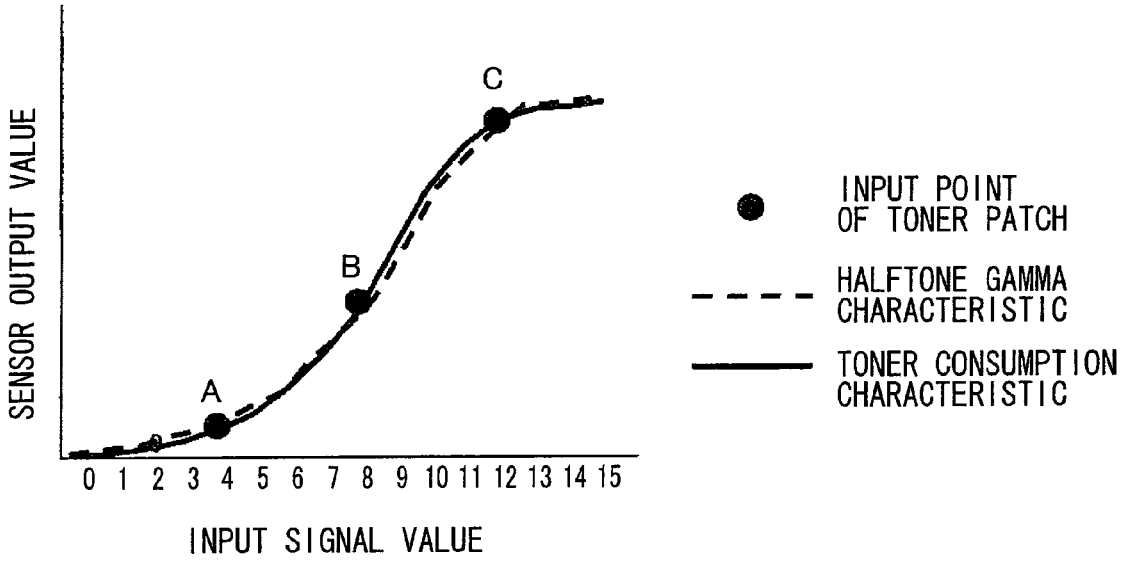
FIG. 3 is a graph indicating a relationship between an input signal value and a sensor output value, the input signal value in the weighting coefficient table illustrated in FIG. 1.
Figure 4:
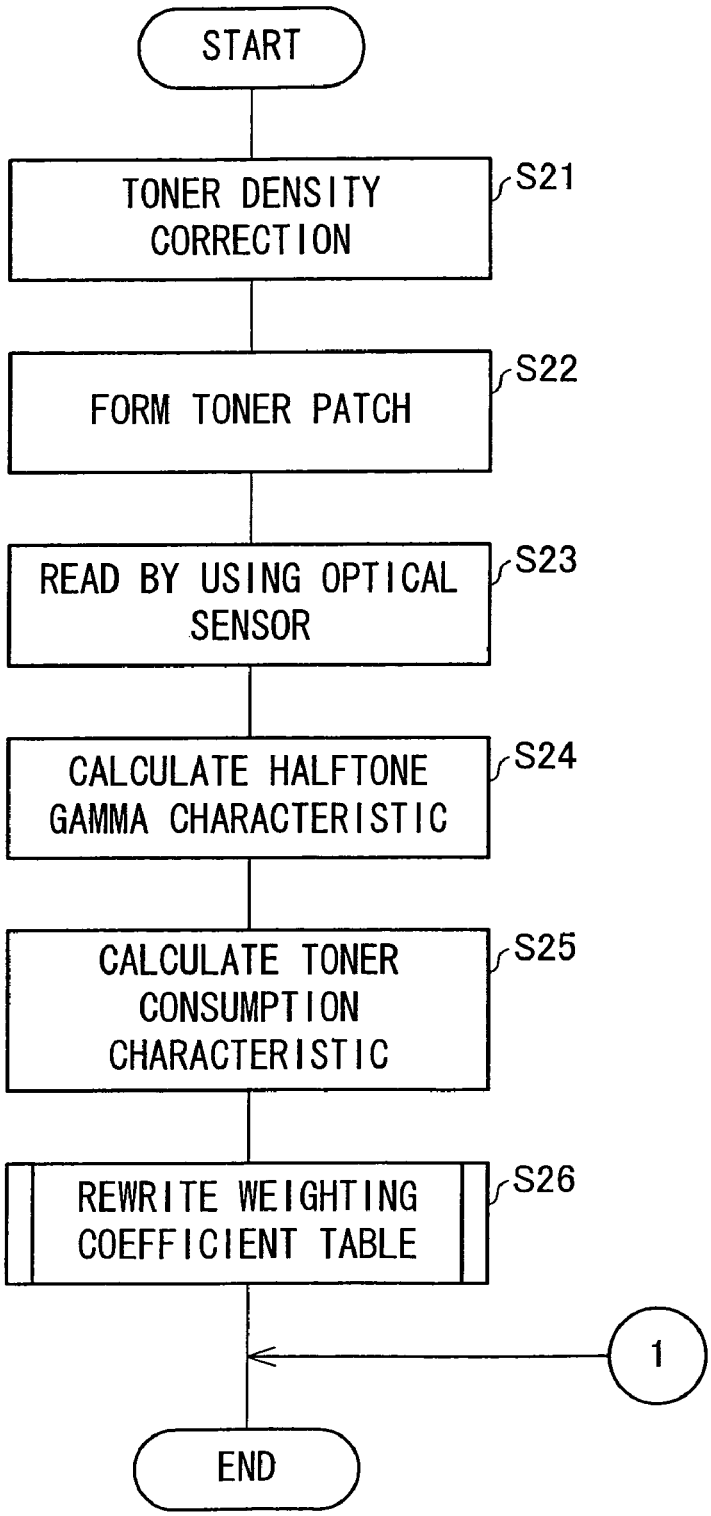
FIG. 4 is a flowchart illustrating a flow of process for rewriting the weighting coefficient table illustrated in FIG. 3.

The following describes, with reference to FIG. 3 and FIG. 4, a process of rewriting the weighting coefficient table 73. The weighting coefficient table 73 is stored in a storage device (storage section, not shown) which is provided in the image forming apparatus 101. The weighting coefficients indicated in the weighting coefficient table 73 are different from conventional weighting coefficients in that (I) the weighting coefficients of the weighting coefficient table 73 are variable, and (II) the weighting coefficients of the weighting coefficient table 73 can be rewritten by the rewriting means 75. Table 2 below indicates an example of the weighting coefficient table 73, where the input signal value ranges from 0 to 15 in 16 values.

TABLE 2

| Weighting Coefficient Table (Variable) | |
|---|---|
| INPUT SIGNAL VALUE | WEIGHTING COEFFICIENT |
| 0 | X0 |
| 1 | X1 |
| 2 | X2 |
| 3 | X3 |
| 4 | X4 |
| 5 | X5 |
| 6 | X6 |
| 7 | X7 |
| 8 | X8 |
| 9 | X9 |
| 10 | X10 |
| 11 | X11 |
| 12 | X12 |
| 13 | X13 |

TABLE 2-continued

| Weighting Coefficient Table (Variable) | |
|---|---|
| INPUT SIGNAL VALUE | WEIGHTING COEFFICIENT |
| 14 | X14 |
| 15 | X15 |

In Table 2, the weighting coefficients (X0 to X15) respectively corresponding to the input signal values 0 to 15 are variable. Each of these weighting coefficients X0 to X15 is rewritten by the rewriting means 75 as follows.

First, after a toner density correction is carried out (S21), a plurality of toner patches whose respective tones are different from one another as indicated by points A to C in FIG. 3 are formed on a photoreceptor, or a transfer belt or the like (S22). In other words, halftone toner patches at a plurality of predetermined input points are formed on the photoreceptor, or the transfer belt or the like. Then, reading means such as an optical sensor is used for reading an amount of light reflected from the toner patches (S23).

Figure 23:
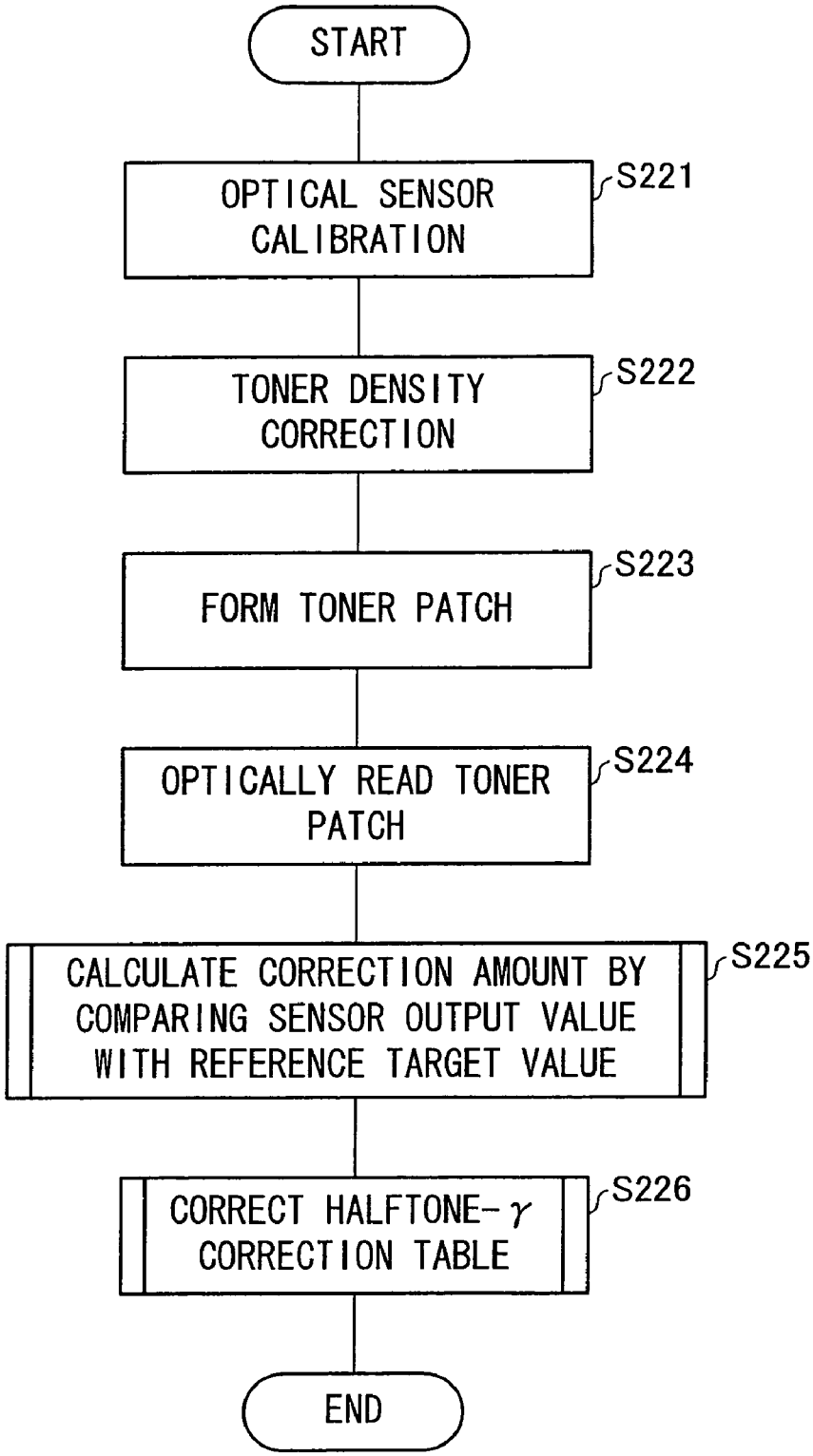
FIG. 23 is a flowchart illustrating a flow of a halftone gamma correction process, using a toner patch.
Figure 24:
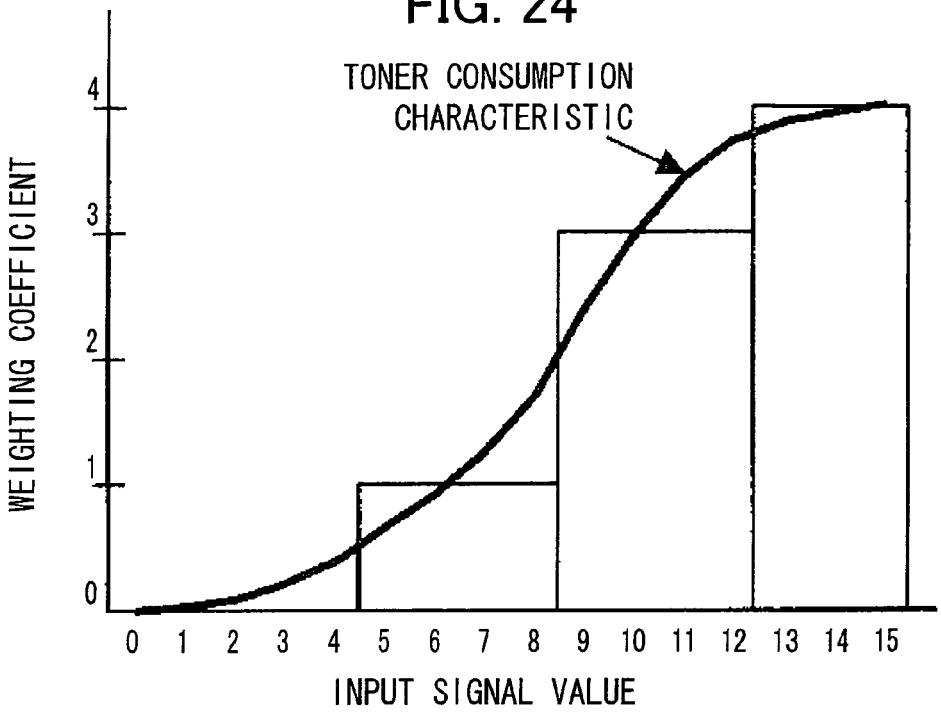
FIG. 24 is a graph indicating a relationship between the input signal value and a weighting coefficient associated thereto, each of which being stored in a conventional weighting coefficient table.
Figure 25:
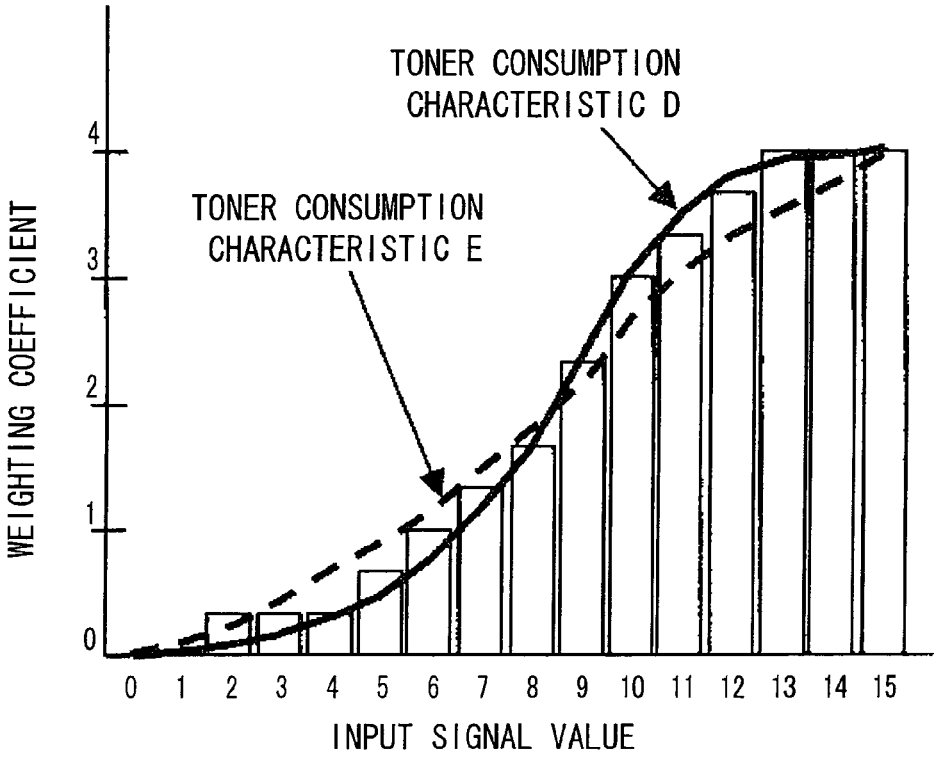
FIG. 25 is a graph indicating a relationship between the input signal value and a weighting coefficient associated thereto, each of which being stored in a conventional weighting coefficient table.

In FIG. 3, the vertical axis represents a value outputted from a sensor of the reading means such as an optical sensor or the like, and the horizontal axis represents an inputted signal value (tone). The number of input point is not particularly limited. It is however preferable that the number of input points be three or more. Note that the procedures in the above described steps S21 to S23 are similar to those of the halftone gamma correction process (i.e., the steps S222 to S224 of FIG. 23) described in the foregoing "Background Art". Accordingly, the following procedures can be carried out by using a result obtained from the halftone gamma correction process.

Based on sensor outputs of the toner patches at the plurality of input points, a halftone gamma characteristic (dotted line in FIG. 3) is calculated (S24). Then, based on the halftone gamma characteristic thus calculated, a toner consumption characteristic (solid line in FIG. 3) for the input signal value is calculated (S25). Then, the weighting coefficient table rewriting process is carried out based on the calculated toner consumption characteristic (S26).

Here, in step S26, the weighting coefficient to be stored in the weighting coefficient table 73 is determined as follows. Namely, based on the toner consumption characteristic calculated in S25, the weighting coefficients stored in the weighting coefficient table 73 are replaced one after another with newly determined weighting coefficients. In the case of the weighting coefficient table of Table 2, the weighting coefficients X0 to X15 respectively corresponding to the input signal values 0 to 15 are rewritten based on the toner consumption characteristic.

By using the weighting coefficients thus rewritten by the rewriting means 75, the pixel count section 70 carries out the pixel count process with respect to the inputted multi-valued image, and the toner consumption amount for the output image is calculated by the toner consumption amount estimating section 80.

Thus, even if the toner consumption characteristic varies amongst various models, or varies due to aging or the like, the weighting coefficients stored in the weighting coefficient table 73 can be rewritten in response to the variation in the toner consumption characteristic. This allows calculation of the toner consumption characteristic to be optimized. As a result, the toner consumption amount can be accurately calculated regardless of the variation amongst the various models, the aging-caused variation, or the like. In other words, it is possible to reduce a difference between the actual toner consumption amount and the toner consumption amount calculated by using the weighting coefficient table 73 which is rewritten by the rewriting means 75.

That is, with the image forming apparatus 101 having the above described configuration, even if the toner consumption characteristic varies amongst various models, or varies due to aging or the like, the weighting coefficients stored in the weighting coefficient table can be rewritten in response to the variation in the toner consumption characteristic. This allows calculation of the toner consumption amount to be optimized. As a result, the toner consumption amount can be accurately calculated regardless of the variation amongst the various models, the aging-caused variation or the like.

However, even if the toner consumption amount is accurately calculated, a small error still occurs due to a variation amongst individual devices, an influence from an environment change, or the like. Such an error, when accumulated, may develop into a significant error. Accordingly, the error increases as the number of the pixel count processes increases. This causes a significant error in the accumulated pixel-count value.

In view of the problem, in the present invention, a significant error in the pixel-count value is prevented as follows. Namely, an amount of the toner actually supplied from a toner-supplying device (toner-supplying container storing section 103, toner supplying section, See FIG. 14) to a developing device 132 (developer tank, see FIG. 14) is detected. The weighting coefficient is rewritten, based on the toner supply amount detected, so as to approximate the calculated value obtained from the pixel count process to the actual toner supply amount. For example, assume a system of a digital printer in which the toner consumption amount is calculated based on the accumulated pixel-count value. It is also assumed here that an actual amount of toner consumed is indicated by the dotted line in the graph of FIG. 6. If the toner consumption amount is calculated based on the accumulated pixel-count value only, the difference between the calculated toner consumption amount and the actual toner consumption amount gradually increases as indicated by the solid line ①. In view of that, the weighting coefficient is corrected; i.e., the pixel-count is corrected, when the toner is supplied, in accordance with an amount of the toner supplied, which means that the signal value counted by the counting means 71 is corrected. This realizes a pixel count process whereby an estimated toner consumption amount becomes closer to the actual toner consumption amount, as indicated by the solid-line ② of FIG. 6. Thus, it is possible to solve the problem that the error in the pixel-count value increases.

Figure 6:
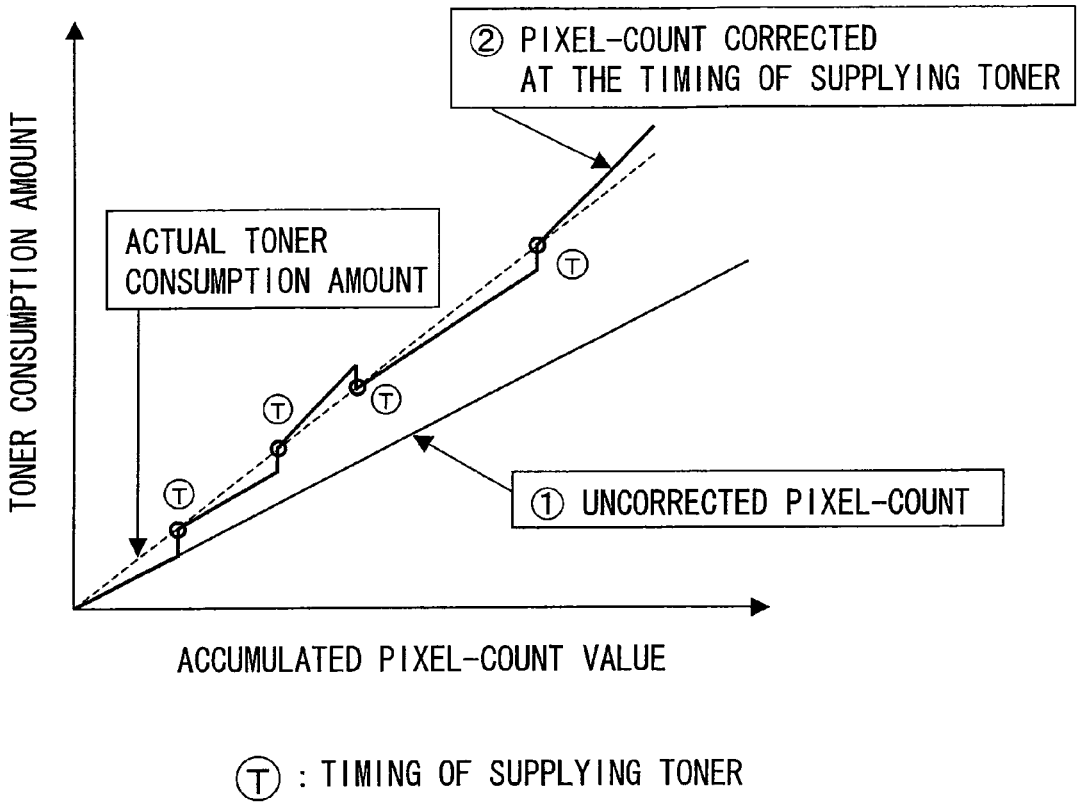
FIG. 6 is a graph indicating relationship between an accumulated pixel-count value and the toner consumption amount, in cases of (I) using pixel-pixel count value only, and (II) correcting the pixel count value at the time of supplying the toner.

For example, in the case represented by the solid line ② of FIG. 6, the pixel-count value is corrected every time the number of the toner supplying operations reaches a predetermined number of times (e.g., 100 times). Here, if 5 g of toner is supplied each time, 500 g of toner is supplied after performing the toner supplying operation 100 times. That is, when the toner supplying operation is performed 100 times, the toner consumption amount is 500 g. Meanwhile, if the toner consumption amount is estimated based on the pixel-count value only, the estimated total toner consumption amount after performing the toner supplying operation 100 times is, for example, 400 g. This is less than the actual amount of the toner consumed.

As described, after the toner supplying operation is performed 100 times, the toner consumption amount which is estimated based on the pixel-count value only is less than the actual toner consumption amount. Accordingly, the weighting coefficient $\alpha$ in Table 2 is multiplied by 500/400=1.25, so as to correct the pixel-count value. This approximates the estimation of the toner consumption amount to the actual toner consumption amount.

As described, the toner consumption amount can be accurately estimated, by adjusting, based on the amount of the toner supplied, the weighting coefficient table which is used for finding the pixel-count value.

Figure 5:
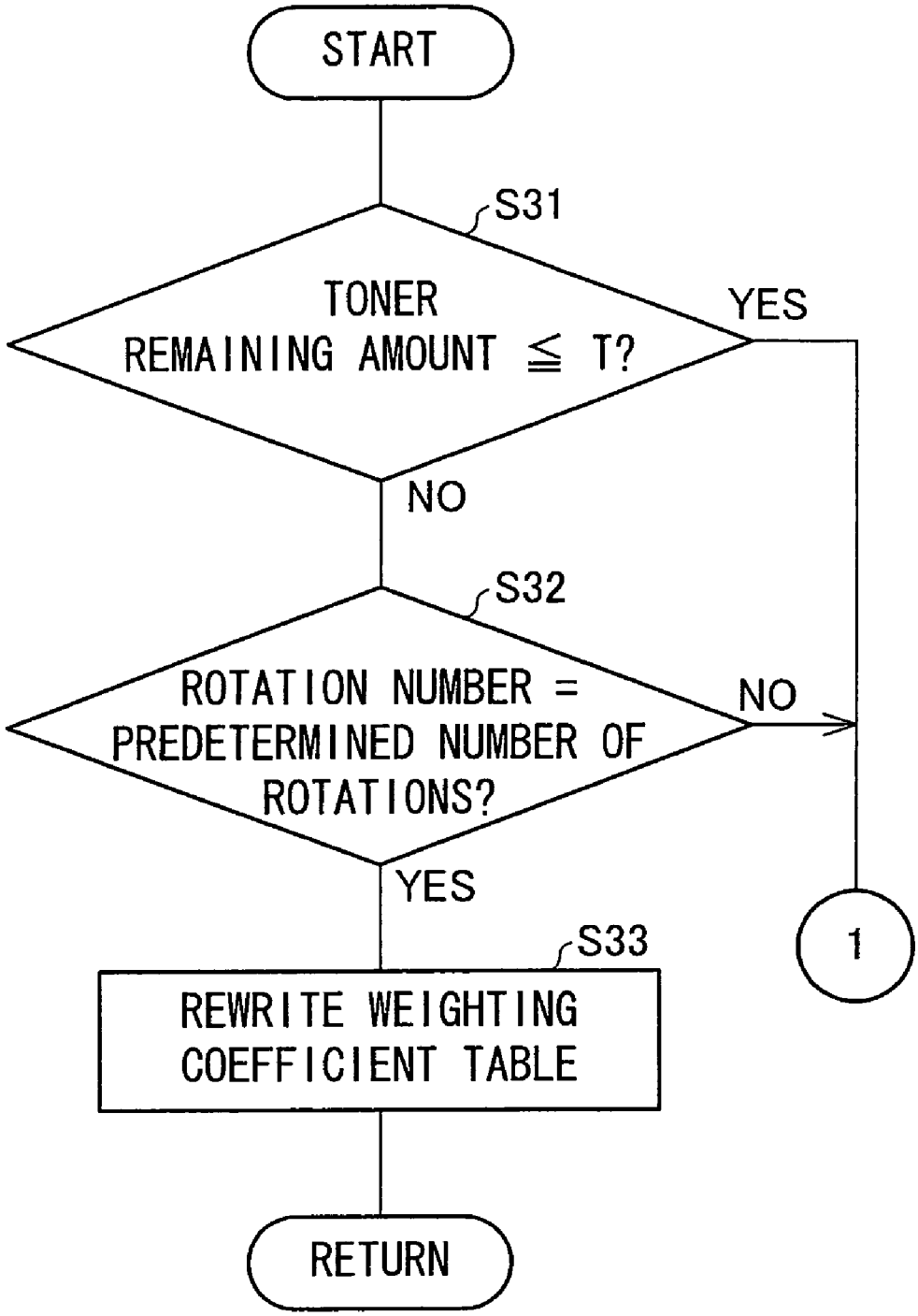
FIG. 5 is a flowchart illustrating a sub-routine of S26 illustrated in FIG. 4.

The following describes how the toner supply amount is utilized for accurately estimating the toner consumption amount, with reference to flowchart of FIG. 5 which illustrates sub routines of the weighting coefficient table rewriting process (S26) of FIG. 4.

First described is how the toner supply amount calculating section 90 calculates the toner supply amount prior to the weighting coefficient table rewriting process.

As illustrated in FIG. 1, the toner supply amount calculating section 90 includes: a toner supply amount detecting section 91; and a rotation number detecting section 92, both of which constitute the toner supply amount detecting means. The rotation number detecting section 92 detects the number of rotations of a rotating member (agitator 140 in FIG. 14) which rotates to supply the toner from a toner hopper (intermediate hopper; described later) to the developer tank. Information of the rotation count detected by the rotation number detecting section 92 is transmitted to the toner supply amount detecting section 91.

In the toner supply amount detecting section (toner supply amount detecting means) 91, the toner supply amount to the developer tank (developing device 132) is detected based on the rotation number information transmitted.

More specifically, an amount of the toner supplied by one rotation of the agitator 140 (See FIG. 14) is substantially constant. As such, by knowing how much one rotation of the agitator 140 supplies the toner from the intermediate hopper 131 to the developing device 132, the toner supply amount can be found by multiplying, by the rotation number of the agitator 140, the amount supplied by one rotation of the agitator 140.

The toner supply amount calculating section 90 transmits the toner supply amount information (information about the toner supply amount, the number of times the toner has been supplied, or the like) to (I) the rewriting means 75 for use in rewriting the weighting coefficient table 73, and (II) the accumulating means 74.

The following describes, with reference to the flowchart of FIG. 5, a process flow for rewriting the weighting coefficient table by using the toner supply amount calculating section 90. Here, FIG. 5 illustrates the process of S26 illustrated in FIG. 4.

First, the rewriting means 75 determines whether or not a toner remaining amount in the toner supplying device (toner-supplying container storing section 103 of FIG. 14, toner supplying section) is at or below a predetermined amount T (S31).

Note that the image forming apparatus 101 of the present embodiment includes a remaining amount detecting device (toner remaining amount detecting means; not shown) which (I) detects the toner remaining amount in the toner supply container storing section 103, and (II) transmits, to the rewriting means 75, remaining amount information indicating the remaining amount. The rewriting means 75 performs the judgment of S31 based on the remaining amount information transmitted from the remaining amount detecting device.

A configuration of the remaining amount detecting device may vary in many ways. For example, the remaining amount detecting device may (a) calculate the toner remaining amount by detecting a weight of a toner supplying container 102 (See FIG. 14) containing the toner and stored in the toner supplying container storing section 103; or (b) detect the toner remaining amount by detecting communication conditions between an IC tag 120 and a communication device 110 (described later).

Further, the predetermined amount T refers to the toner amount, called toner near-end, in the toner supplying device. The toner near-end is the amount of toner remaining in the intermediate hopper 131 illustrated in FIG. 14 but is too low to supply a constant amount to the developing device 132.

In other words, in the toner supplying device, when the toner remaining amount in the intermediate hopper 131 reaches to the near-end (almost running out), a constant amount of toner cannot be supplied. This causes difficulties in accurately calculating the toner consumption amount, with the result that one cannot accurately predict how many more copies can be printed out. Thus, the predetermined amount T is the amount determined for solving the above problems.

In S31, if the toner remaining amount in the intermediate hopper 131 is at or below T, the rewriting means 75 ends the process. In this case, the toner remaining in the intermediate hopper 131 (i.e., in the toner-supplying device) has been run out almost completely, i. e., the toner near-end. The toner consumption amount therefore cannot be accurately estimated.

On the contrary, if the remaining amount of the toner is more than T in S31, the rewriting means 75 proceeds to S32, and determines whether or not the number of rotations of the rotating member (agitator 140) for use in supplying the toner has reached a predetermined number of rotations. This is carried out based on the information transmitted from the toner supply amount calculating section 90. Here the predetermined number of rotations is the number or rotations which absorbs the error in the amount of toner supplied by each rotation. Such a predetermined number of rotations may be 100 times, 500 times, 1000 times, or the like.

In S32, if the number of rotations of the rotating member (agitator 140) has not yet reached the predetermined rotation number, the rewriting means 75 ends the process. On the other hand, if the number of rotations has reached the predetermined rotation number, the sequence proceeds to S33 and the weighting coefficient table rewriting process is executed.

Here, weighting coefficient $\alpha$=(an amount of toner supplied by predetermined number of rotations of the agitator 140)/(a total amount of consumed toner determined based on the pixel-count values during the predetermined number of rotations of the agitator 140.

By using a for rewriting the weighting coefficient table, the toner consumption amount calculated based on the pixel-count value can more accurately be approximated to the actual toner consumption amount.

In the foregoing example, each of the pixel input values is multiplied by the weighting coefficient, and the resulting values of the respective pixels are accumulated To determine the toner consumption amount. However, the toner consumption amount may alternatively be estimated by directly accumulating the weighting coefficients of the respective pixels, using the consumed amount of toner as the weighting coefficients.

In the above configuration, the toner supply amount detecting section 91 detects the amount of the toner supplied to the developing device 132. The counting means 71 detects the signal values of the respective pixels constituting the input image. The weighting calculation means 72 carries out the weighting process with respect to the signal values, by using the weighting coefficients. Then, the accumulating means 74 accumulates the weighted signal values, and the toner consumption amount estimating section 80 estimates the toner consumption amount based on the accumulated value.

In short, the toner consumption amount estimating section 80 estimates the toner consumption amount based on the signal values counted by the counting means 71.

Further, in the above configuration, the rewriting means 75 rewrites the weighting coefficient table, in accordance with the toner supply amount detected by the toner supply amount detecting section 91. As such, the signal values detected by the counting means 71 are corrected, in the weighting process, in accordance with the toner supply amount. That is, in accordance with the toner supply amount detected by the toner supply amount detecting section 91, the rewriting means 75 corrects the signal values detected by the counting means 71.

Thus, the toner consumption amount estimating section 80 estimates the toner consumption amount based on the signal values corrected.

The amount of toner supplied to the developer tank is substantially equal to the amount of toner consumed in the developer tank. By utilizing this fact, the signal values are corrected in accordance with the amount of the supplied toner, and the toner consumption amount is estimated based on the corrected signal values. This allows the estimated toner consumption amount to be approximated to the actual toner consumption amount. Thus, the toner consumption amount can be estimated more accurately, even if the toner consumption characteristic varies amongst various models, or varies due to aging, surrounding environment, or the like.

Note that, in the above configuration, the toner supply amount detecting section 91 detects the toner supply amount based on the number of rotations of the agitator 140. However, the present invention is not limited to this. For example, it is possible to provide means which times a total rotation time of the agitator 140, and the toner supply amount detecting section 91 may detect the toner supply amount based on the total rotation time so obtained. Since the rotation time of the agitator 140 and the toner supply amount correlate with each other, the toner supply amount can be detected based on the total rotation time.

Further, in the above configuration, the rewriting means 75 rewrites the weighting coefficient table every time the number of rotations of the rotating member (agitator 140), for use in supplying the toner, reaches the predetermined number of rotations. Here, the amount of toner supplied by one rotation is substantially constant. Thus, the rewriting means 75 rewrites the weighting coefficient table every time the toner supply amount reaches a predetermined amount. This is for absorbing an error in the amount of toner supplied by one rotation. More specifically, it is extremely difficult to accurately supply, by each rotation, a constant amount of toner. However, since the amount of toner supplied by a certain number of rotations such as 100 rotations or 500 rotations is substantially constant, the toner consumption amount can be accurately estimated by correcting the signal values every time the toner supply amount reaches the amount supplied by a certain number of rotations.

Further, in the above configuration, the rewriting means 75 does not rewrite the weighting coefficient table if the rewriting means 75 determines that the toner remaining amount is at or below the predetermined amount.

Accordingly, the weighting coefficient table is not rewritten when the toner remaining amount is at the near-end where errors more likely occur. This allows for a stable calculation of the toner consumption amount with little error.

Next, the following describes, with reference to FIG. 7 through FIG. 19, an example of the developer tank and the toner-supplying device, both of which are used in the image forming apparatus 101 of the present embodiment.

The following describes, with reference to FIG. 7 through FIG. 19, the developer tank and the toner-supplying device.

The image forming apparatus 101 of the present embodiment forms an image by using toner which is supplied to the developer tank 132 at a certain rate. The image forming apparatus 101 may be, for example, a printer or copy machine which adopts an electrophotographic system, a facsimile, or a digital complex machine having functions of these devices. Further, the image forming apparatus 101 detects a rotation angle of a rotating device (toner supplying container 102; described later) by wirelessly communicating with the rotating device, which rotates in the main body of the image forming apparatus 101. The rotating device is not particularly limited as long as the rotating device is a member which can be driven to rotate. The following deals with a case where the rotating device is the toner supplying container (a developer supplying container) for containing therein the toner (content, developer) to be supplied to the developer tank.

Figure 7:
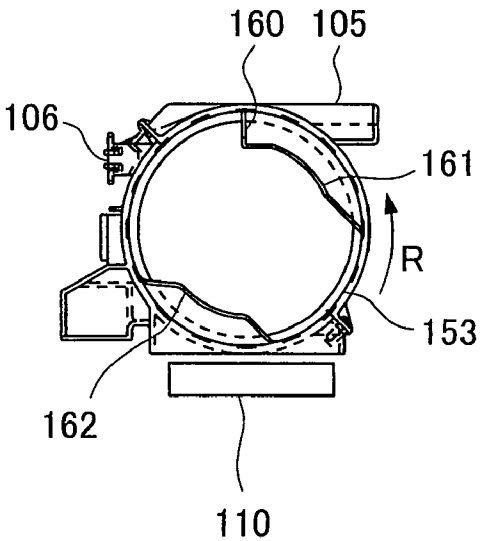
FIG. 7(*a*) is a side view of a toner supplying container provided to the image forming apparatus of an embodiment in accordance with the present invention, and FIG. 7(*b*) is a cross sectional view of a third container of the toner supplying container.
Figure 7:
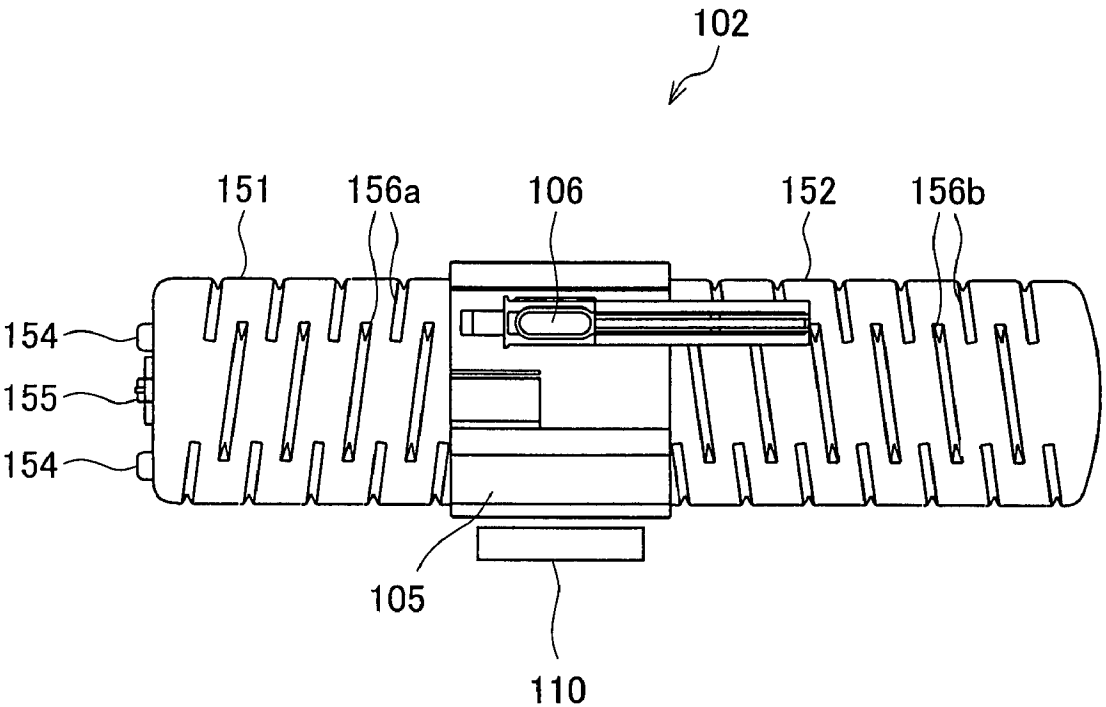
Figure 8:
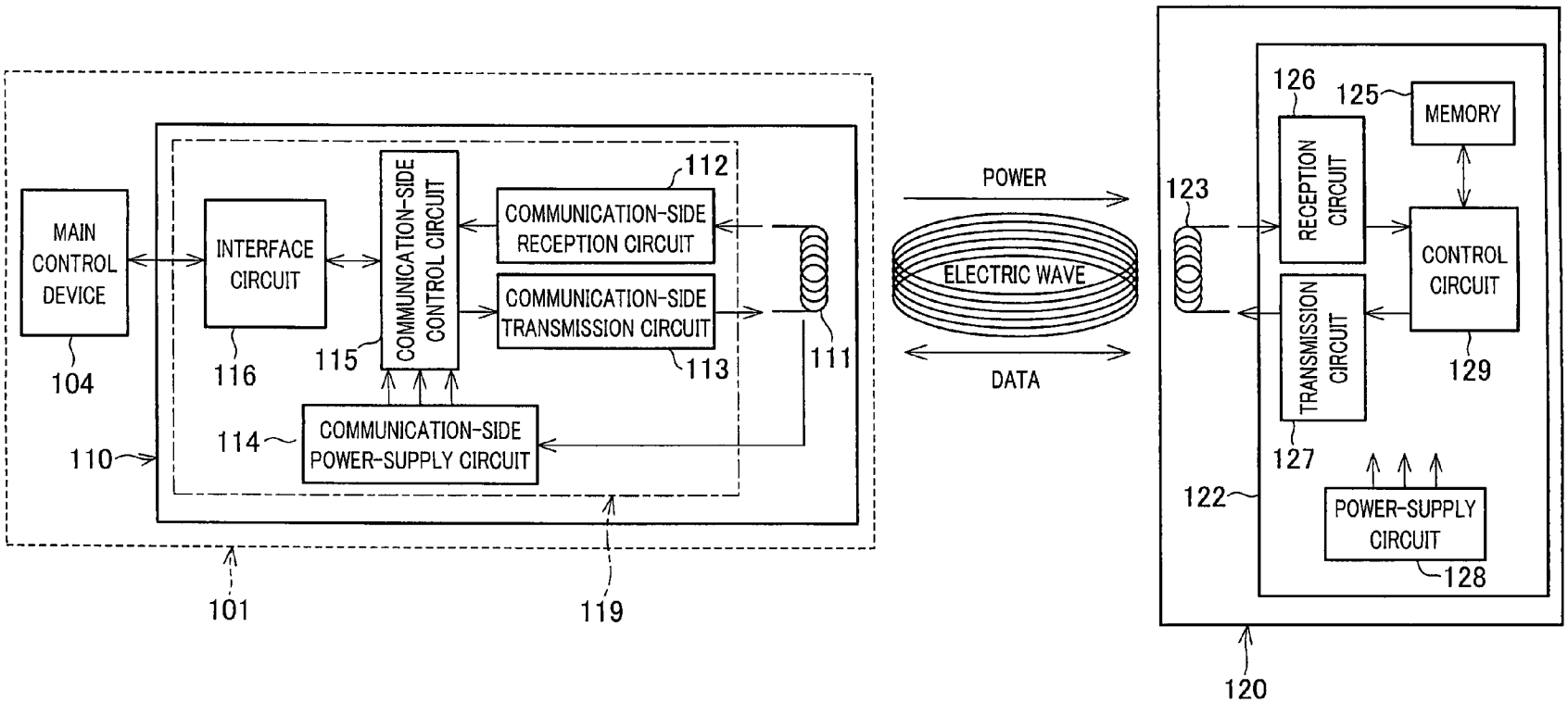
FIG. 8 is an block diagram for explaining a communication performed between a communicating device provided to the image forming apparatus of the embodiment and an IC tag attached to the toner supplying container.

FIG. 8 is a block diagram illustrating communications performed between the main body of the image forming apparatus 101 and the toner supplying container 102. Further, FIG. 9, FIG. 7(*a*) and FIG. 7(*b*) are respectively a perspective view, a side view, and a cross sectional view of the toner supplying container 102.

As illustrated in FIG. 7(*a*), the image forming apparatus 101 includes: the toner supplying container 102 serving as the rotating device and including an IC tag (communicating element) 120 (See FIG. 8) which is attached to the peripheral surface (outer surface) of the toner supplying container 102; a communication device 110 for communicating, via a contactless communication element, with the IC tag 120; and a main control device (rotation angle detecting section, toner remaining amount detecting means) 104 (See FIG. 8) such as a CPU, for controlling various operations in the image forming apparatus 101. As illustrated in FIG. 7(*a*), the communication device 110 is so arranged as to face the peripheral surface of the toner supplying container 102 in a non-contact manner.

More specifically, as illustrated in FIG. 7(*a*) and FIG. 7(*b*), the communication device 110 is so arranged that, when the toner supplying container 102 is mounted to the image forming apparatus 101, the communication device 110 faces the lowermost portion on the peripheral surface varies its position within the image forming apparatus 101, along with the rotation of the toner supplying container 102. However, the foregoing configuration ensures that the IC-tag 120 faces the communication device 110 at least once in one rotation of the toner supplying container 102.

Figure 10:
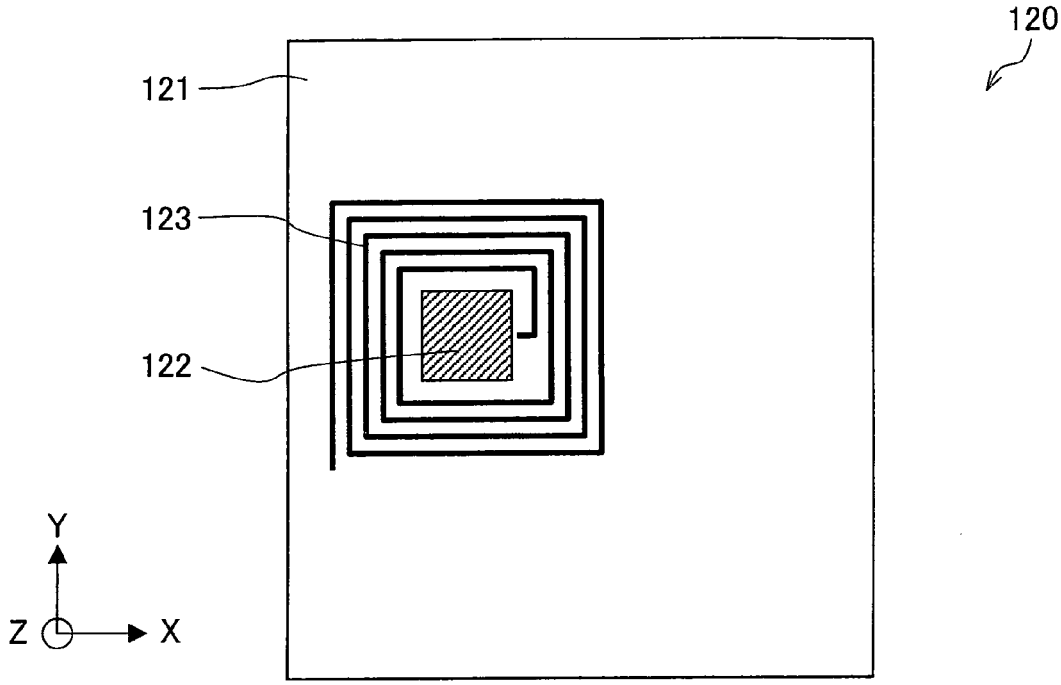
FIG. 10(*a*) is a plane view of the IC tag illustrated in FIG. 8, FIG. 10(*b*) is a cross sectional vie of the IC tag, and FIG. 10(*c*) is an explanatory diagram illustrating communication directivity of the IC tag.
Figure 10:
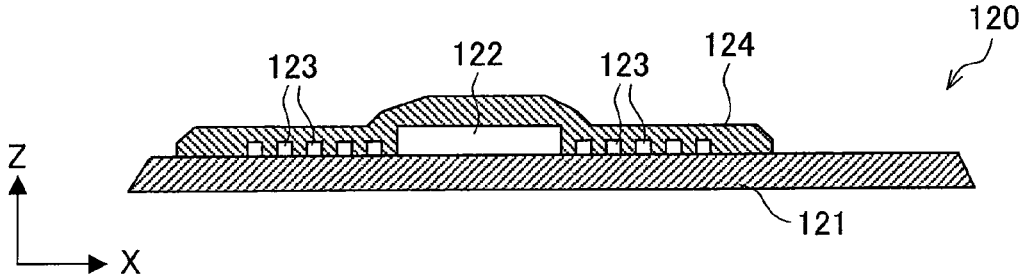
Figure 10:
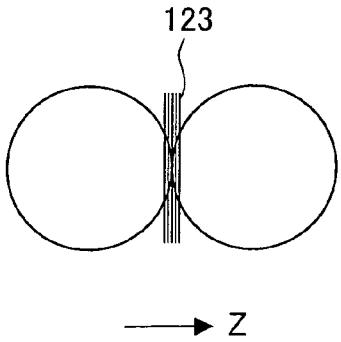

FIG. 10 (*a*) and FIG. 10 (*b*) are respectively a plane view and a cross sectional view of the IC-tag 120. Further, FIG. 10 (*c*) illustrates a directivity of communication using the IC-tag 120.

As illustrated in FIG. 10 (*b*), the IC-tag 120 includes an IC chip 122 and an antenna section 123 which are electrically connected to each other. More specifically, as illustrated in FIG. 10 (*a*) and FIG. 10 (*b*), the IC-tag 120 has the IC chip 122 and the antenna section 123 on a base film 121. The IC chip 122 includes various circuits as will be described later, and the antenna section 123 is a wiring of metallic thin film or the like wrapped around the IC chip several times in such a looping manner that the antenna section 123 surrounds the IC chip 122. Further, as illustrated in FIG. 10 (*b*), the IC chip 122 and the antenna section 123 are covered with a protection film 124.

The antenna section 123 transmits and receives a communication wave, which is an electromagnetic wave, during the information communication with the communication device 110 (See FIGS. 7(*a*)(*b*)). The antenna section 123 may be separately provided for transmission and reception. Alternatively, the antenna section 123 may be capable of performing both transmission and reception of the electromagnetic wave. As illustrated in FIG. 10(*c*), the directivity of the communications performed by the antenna section 123 to transmit/receive information is confined in a direction projecting out of the plane of the antenna section 123 surrounding the IC chip 122 (i.e., circled region along the Z-direction in the figure).

Meanwhile, as illustrated in FIG. 8, the communication device 110 provided in the image forming apparatus 101 includes: a communication-side antenna (communicating section) 111 and an IC section 119 having various circuits described later. The communication-side antenna 111 enables the wireless transmission and/or reception of information, allowing information to be read from the IC-tag 120 provided in the toner supplying container 102, and/or written into the IC-tag 120. As is the case of the antenna section 123, the communication-side antenna 111 also has directivity (not shown) of communication in transmitting and receiving information.

As described, the IC-tag 120 and the communication device 110 both have directivity of communication. Here, the performance of the information communication between the IC-tag 120 and the communication device 110 is optimized when the directivity of the antenna section 123 of the IC-tag 120 and that of the communication-side antenna 111 coincide or are parallel with each other. Note that, as used herein, "coincide" and "parallel with each other" also mean "substantially coincide" and "substantially parallel with each other."

In order to optimize information communication between the IC-tag 120 and the communication device 110, the communication-side antenna 111 of the communication device 110 and the antenna section 123 of the IC-tag 120 are preferably arranged so that the directivity of the antenna section 123 and that of the communication-side antenna 111 coincide or are parallel with each other at least once in one rotation of the toner supplying container 102 in an R direction indicated in FIG. 7 (*b*).

Further, as described, the IC-tag 120 and the communication device 110 have directivity of communication. On this account, communication conditions between the IC-tag 120 and the communication device 110 vary depending on relative positions of the antenna section 123 of IC-tag 120, and the communication-side antenna 111 of the communication device 110. Moreover, since the electromagnetic wave is used for the communication between the IC-tag 120 and the communication device 110, the communication conditions vary depending on: (I) a distance between the antenna section 123 and the communication-side antenna 111; and (II) an influence of an intervening object, such as a dielectric layer , or a semiconducting or magnetic layer, existing between the antenna section 123 and the communication-side antenna 111.

In the image forming apparatus 101 of the present embodiment, the IC-tag 120 is provided on the toner supplying container 102, and the communication-side antenna 111 is disposed and fixed on a predetermined position of the image forming apparatus 101. Accordingly, when the toner supplying container 102 rotates, the relative positions of the communication-side antenna 111 and the antenna section 123 vary. Along with this change in the relative positions, the communication conditions between the IC-tag 120 and the communication device 110 also vary.

Figure 11:
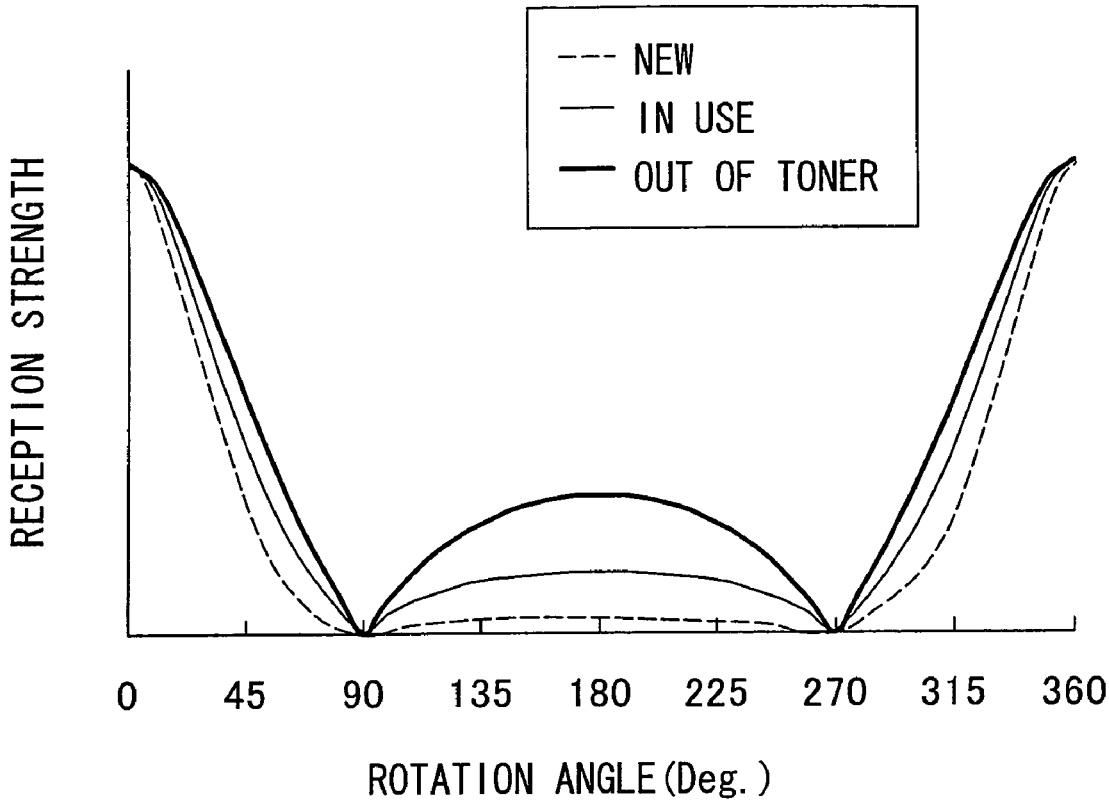
FIG. 11 is a graph indicating a relationship between a rotation angle of the toner supplying container illustrated in FIG. 8, and a reception sensitivity of the communicating device.
Figure 12:
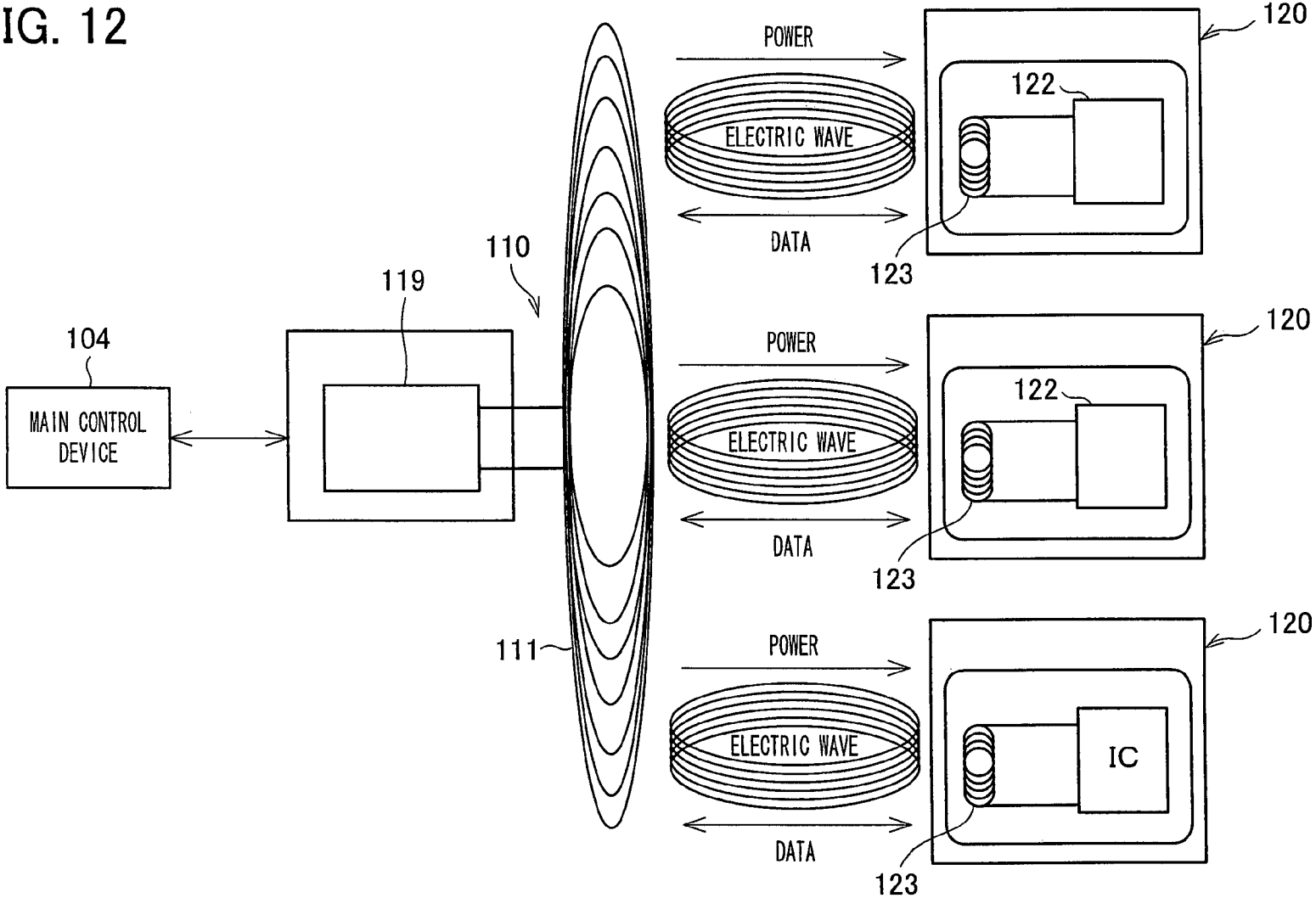
FIG. 12 is a block diagram for explaining communications performed between the communicating device illustrated in FIG. 8, and a plurality of IC tags.

For example, the communication conditions between the IC-tag 120 and the communication device 110 vary as illustrated in FIG. 11, along with the rotation of the toner supplying container 102. FIG. 11 is a graph representing the reception intensity of IC-tag 120 output (communication wave) received by the communication device 110, plotted against the rotation angle of the toner supplying container 102.

The communication status between the IC-tag 120 and the communication device 110 is optimized (I) when the directivity of the antenna section 123 of the IC-tag 120 and that of the communication-side antenna 111 of the communication device 110 coincide or are parallel with each other; and (II) when the antenna section 123 and the communication-side antenna 111 face each other with the closest distance. As such, in the image forming apparatus 101 of the present embodiment, the IC-tag 120 and the communication device 110 are deemed as to be facing each other when the reception strength is strongest. Further, at this point, the antenna section 123 and the communication-side antenna 111 can be deemed as to coincide or be parallel with each other, and the distance between the antenna section 123 and the communication-side antenna 111 can be deemed as to be the closest. In FIG. 11, the toner supplying container 102 has the rotation angle of 0° when the reception strength is at maximum.

Meanwhile, as illustrated in FIG. 11, the reception strength is minimized when the rotation angle of the toner supplying container 102 is 90° or 270°, with respect to the reference angle of 0°. At this point, the IC-tag 120 of the toner supplying container 102 and the communication device 110 are not facing each other, and the directivity of the antenna section 123 and that of the communication-side antenna 111 are crossing each other.

Further, as illustrated in FIG. 11, when the rotation angle of the toner supplying container 102 is 180° with respect to the reference rotation angle of 0°, the reception strength is between (I) the reception strength obtained when the rotation angle is 0°, and (II) the reception strength obtained when the rotation angle is 90° or 270°. When the rotation angle is 180°, the IC-tag 120 and the communication device 110 are facing each other, via the toner supplying container 102. Accordingly, the directivity of the antenna section 123 and that of the communication-side antenna 111 coincide or are parallel with each other. However, between the antenna section 123 and the communication-side antenna 111, there is an intervening member such as the toner supplying container 102 or the toner. This intervening member attenuates the electromagnetic wave used for the communication, although the communication is still enabled between the antenna section 123 and the communication-side antenna 111. Accordingly, when the rotation angle is 180°, the reception strength is between (I) the reception strength obtained when the rotation angle is 0°, and (II) the reception strength obtained when the rotation angle is 90° or 270°.

Further, the reception strength also varies in accordance with an amount of toner in the toner supplying container 102. That is, the toner in the toner supplying container 102 works as a dielectric layer, and weakens the electromagnetic wave outputted from the antenna section 123 or the communication-side antenna 111. Accordingly, the reception strength also varies as illustrated in FIG. 11, in accordance with the amount of toner in the toner supplying container 102.

More specifically, as illustrated in FIG. 11, the reception strength of the communication device 110 becomes weaker in the following order: (I) when the toner supplying container 102 contains no toner, as in a completely-used toner supplying container 102 (thick-solid line); (II) when some of the toner in the toner supplying container 102 has been consumed, as in a toner supplying container 102 in use (thin solid line); and (III) when the toner supplying container 102 is filled with toner, as in the brand new toner supplying container 102 (dotted-line).

Accordingly, in the image forming apparatus 101, the main control device 104 (FIG. 8) detects the reception strength of the communication device 110 or monitors changes in the reception strength, so as to detect the rotation angle of the toner supplying container 102 and the toner remaining amount. This allows for suitable control of a rotation stopping position of the toner supplying container 102 and a timing at which a communication is performed between the IC-tag 120 and the communication device 110.

As described, the rotation angle of the toner supplying container 102 can be controlled by detecting the reception strength of the communication between the IC-tag 120 and the communication device 110. More specifically, it is the main control device 104 (FIG. 8), provided in the image forming apparatus 110, which controls the rotation angle of the toner supplying container 102 based on the communication between the IC-tag 120 and the communication device 110.

That is, for example, the main control device 104 determines the rotation angle 0° as follows. The rotation angle 0° is set as the rotation stopping position of the toner supplying container 102 where (I) the antenna section 123 and the communication-side antenna 111 face each other, and (II) the respective directivities coincide or are parallel with each other. Alternatively, the reception strength is detected in one rotation of the toner supplying container 102, and the rotation stopping position that provides the maximum reception strength is set as the rotation angle 0°. By setting the rotation angle 0° in this manner, the relationship between the rotation angle of the toner supplying container 102 and the reception strength can be represented as shown in FIG. 11. The detected reception strength can then be compared with the graph of FIG. 11 to find a rotation angle of the toner supplying container 102.

The reception strength indicated by the graph of FIG. 11 may be stored beforehand in the form of table, and the graph may be compared with the reception strength of the communication to find a reception angle of the toner supplying container 102

Figure 13:
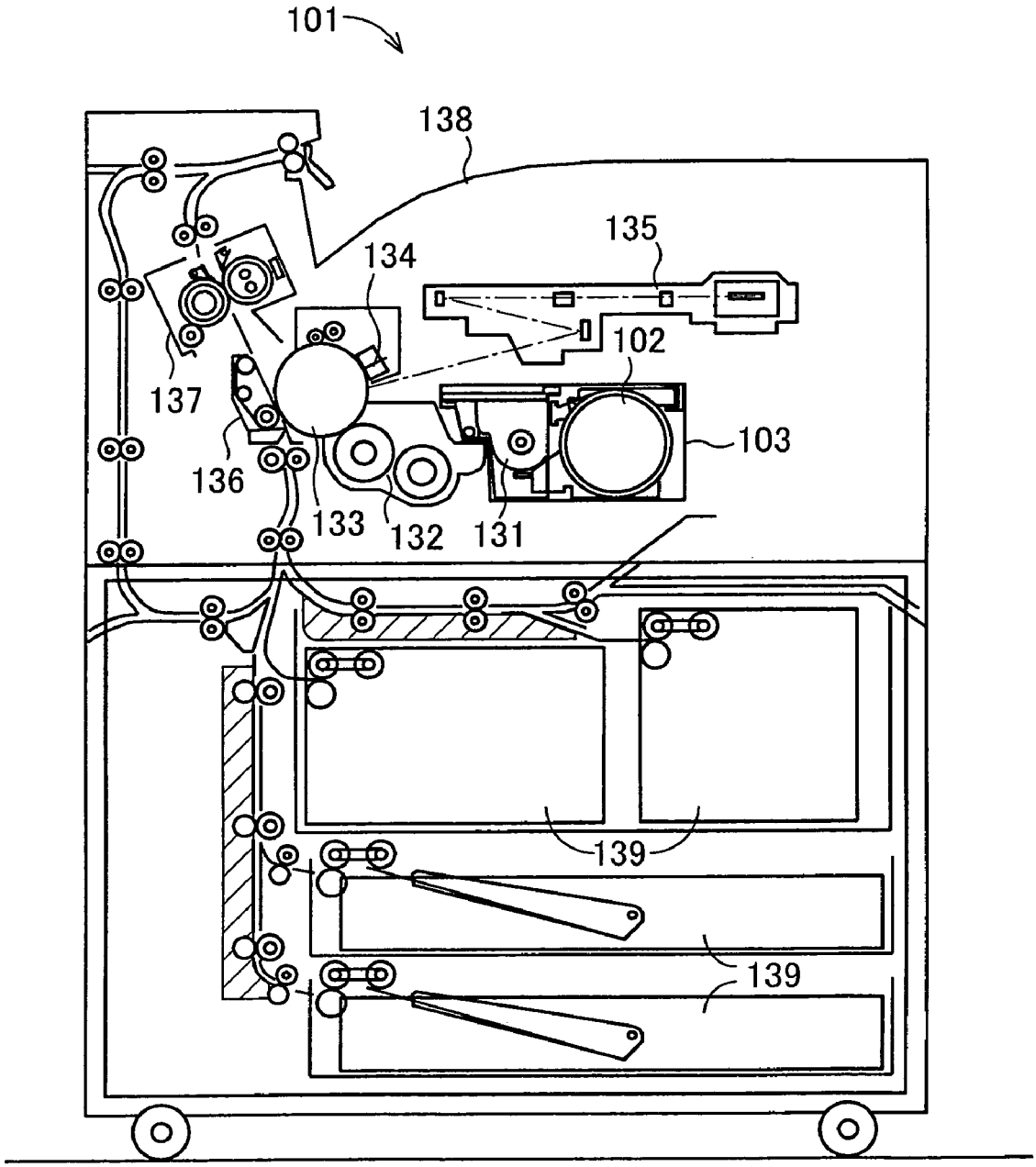
FIG. 13 is a schematic front view of the image forming apparatus in accordance with an embodiment of the present invention.

Next described is the image forming apparatus 101 having the toner supplying container 102. FIG. 13 is a front view of the image forming apparatus 101, and FIG. 14 is a front view of a main part of the image forming apparatus 101.

As illustrated in FIG. 13, the image forming apparatus 101 includes: the toner supplying container 102; the toner supply container storing section 103 to which the toner supplying container 102 is attached in a detachable manner; the intermediate hopper 131; the developing device 132; a photosensitive drum 133; a charger 134; a laser-exposure device 135; a transfer device 136; a fixing section 137; a sheet delivering section 138; and a sheet feeding section 139.

The toner supply container storing section 103 is provided to install the toner supplying container 102 in the image forming apparatus 101. The toner supply container storing section 103 stores the toner supplying container 102 illustrated in FIGS. 7(*a*) and 7(*b*), in such a manner that the toner supply container storing section 103 covers the entire toner supplying container 102. With the toner-supply container, the toner supplying container 102 is fixed in the image forming apparatus 101.

As illustrated in FIG. 14, the toner supply container storing section 103 has therein the communication device 110 including the communication-side antenna 111. The communication device 110 is located at a position on a main body side of the image forming apparatus 101 so as to face, in a non-contact manner, the toner supplying container 102 in the toner supply container storing section 103. Further, the toner supplying container 102 has an electromagnetic shield material 107 which is integrally provided with the toner supply container storing section 103. The electromagnetic shield material 107 covers at least the communication-side antenna 111 and the IC-tag 120, so as to prevent problems in information communication performed between the communication-side antenna 111 and the IC-tag 120, while the toner supplying container 102 is attached to the toner supply container storing section 103.

With the electromagnetic shield material 107, the information communication performed between (I) the communication device 110 and (II) the IC-tag 120 provided in the toner supplying container 102 is protected from adverse effects of an external electromagnetic wave or the like. This realizes a stable radio communication between the communication device 110 and the IC-tag 120.

The intermediate hopper 131 includes the agitator 140 which agitates the toner supplied from the toner supplying container 102, and supplies the toner to a subsequent stage. The developing device 132 carries out a developing process by using the toner supplied from the intermediate hopper 131. The photosensitive drum 133 is an image carrier for carrying an electrostatic latent image, or a toner image visualized from the electrostatic latent image. The charger 134 illustrated in FIG. 13 is for electrically charging the photosensitive drum 133. The laser-exposure device 135 is for forming the electrostatic latent image on the photosensitive drum 133, by irradiating a laser to the electrically charged photosensitive drum 133. The transfer device 136 is for transferring, onto a sheet, the toner image formed on the photosensitive drum 133. The fixing section 137 is for fixing the toner image on the sheet, through a thermal compression bonding. To the sheet delivering section 138, the sheet having been subjected to the printing process (image formation) is ejected. The sheet feeding section 139 stores therein sheets to be subjected to the printing process.

In the image forming apparatus 101 having the above described configuration, the image is formed as follows. Namely, the charger 134 of FIG. 13 electrically charges a surface of the photosensitive drum 133. Then, the laser-exposure device 135 forms the electrostatic latent image on the surface of the photosensitive drum 133, based on the image information. Meanwhile, the toner supplied from the toner supplying container 102 to the intermediate hopper 131 is agitated by the agitator 140 illustrated in FIG. 14, and is fed to the developing device 132 by the rotation of a toner-supplying roller 141. Then, in the developing device 132, the electrostatic latent image on the photosensitive drum 133 is visualized by using the toner supplied from the intermediate hopper 131, so that the toner image is formed. The toner image formed on the photosensitive drum 133 is transferred, by using the transfer device 136, onto the recording sheet having been fed from the sheet feeding section 139. After the toner image transferred onto the recording sheet is fixed through the thermal compression bonding process carried out in the fixing section 137, the recording sheet is ejected to the sheet delivering section 138.

Figure 15:
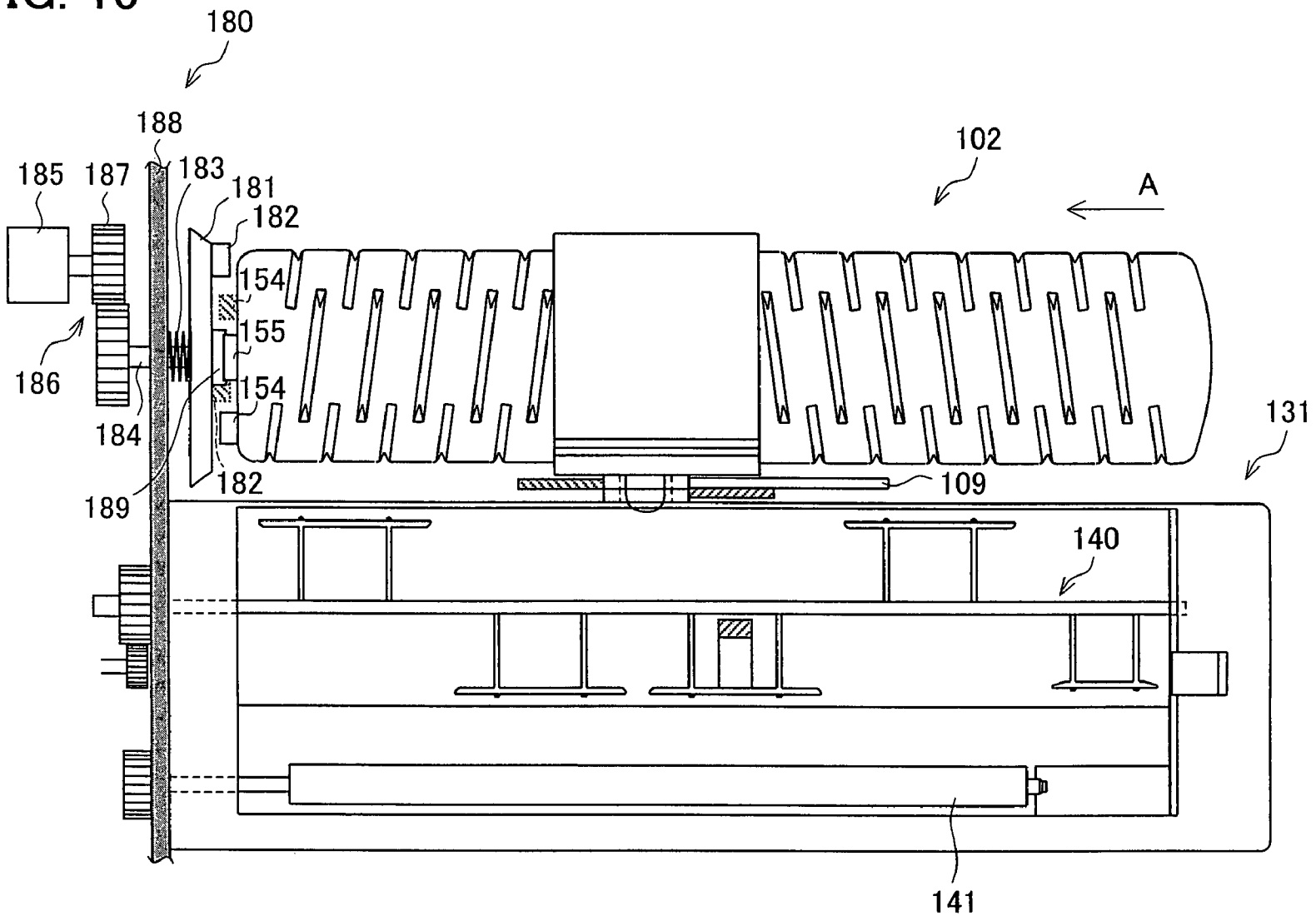
FIG. 15 is a top view illustrating the toner supplying container illustrated in FIG. 15, and a main-body-side connecting section of the image forming apparatus.
Figure 16:
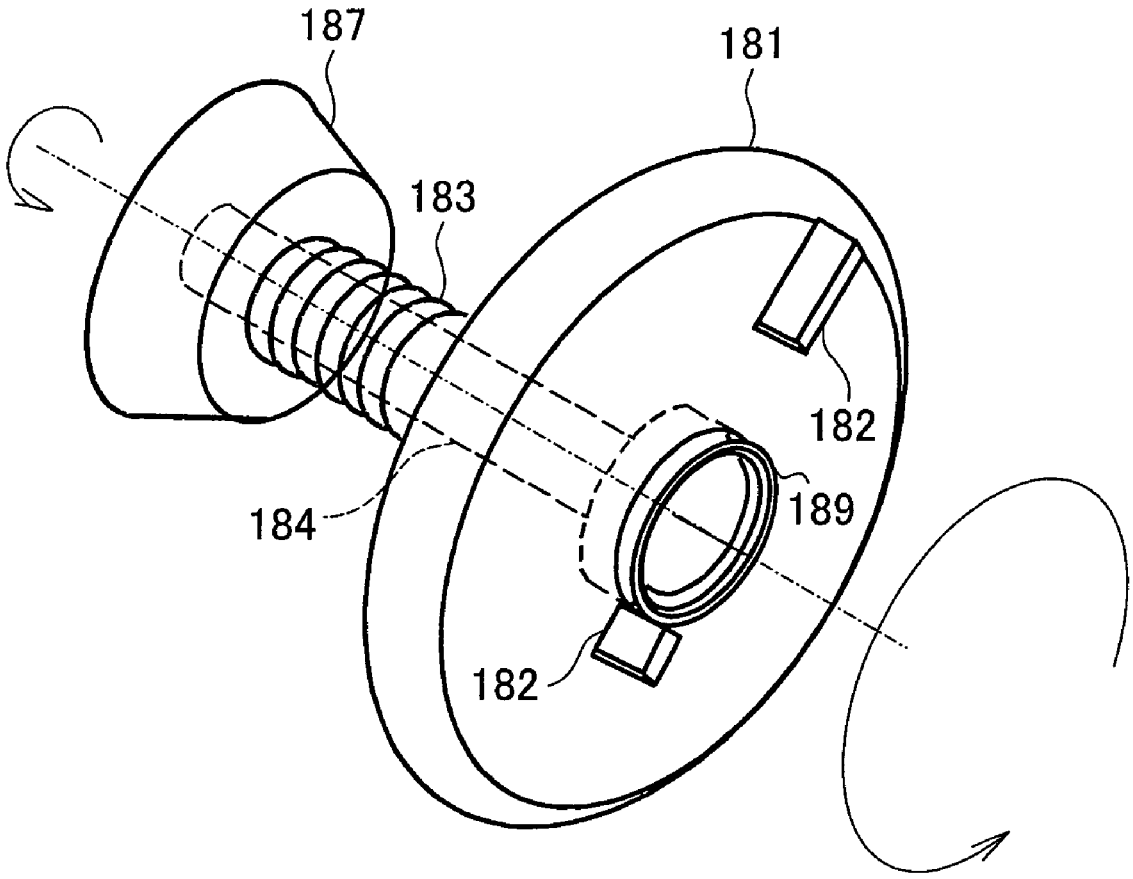
FIG. 16 is a perspective view of a main part of the main-body-side connecting section illustrated in FIG. 15.

Next described in detail is the toner supplying container 102 attached to the image forming apparatus 101. FIG. 15 is a top view illustrating the toner supplying container 102, and a main-body-side connecting section 180 of the image forming apparatus 101. FIG. 16 is a perspective view illustrating a main part of the main-body-side connecting section 180.

Figure 9:
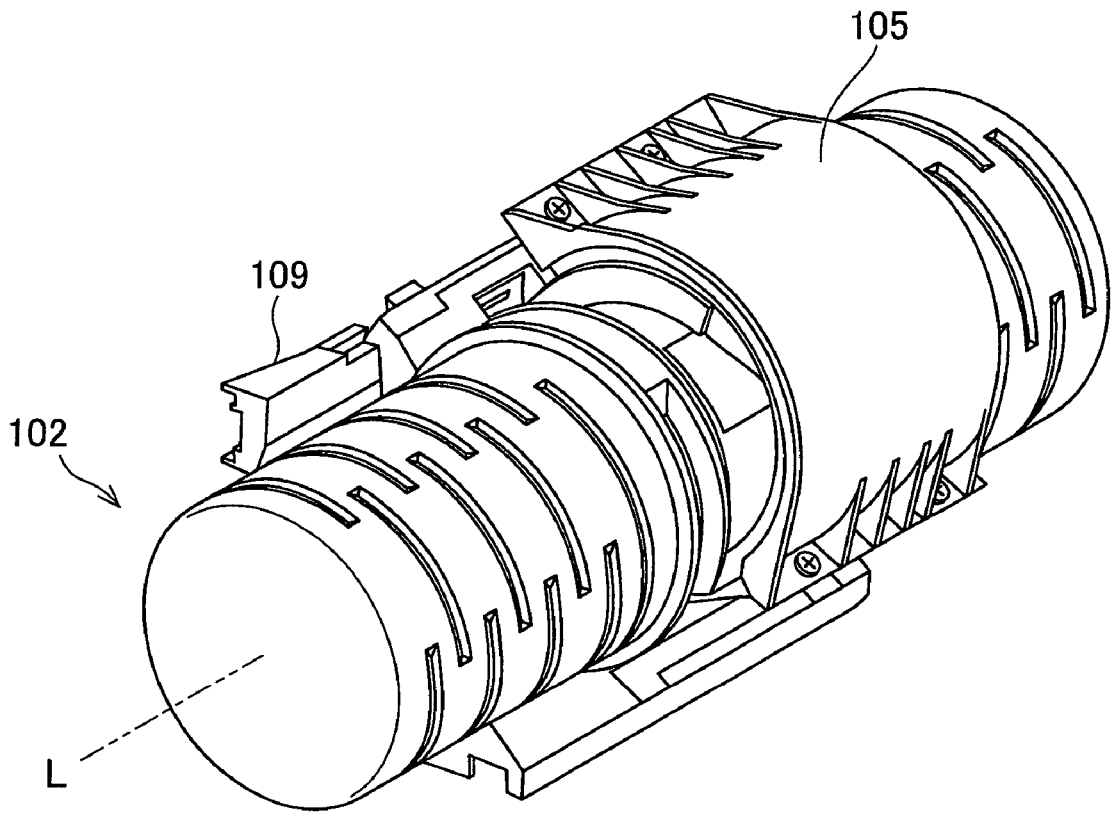
FIG. 9 is a perspective view of the toner supplying container provided to the image forming apparatus in accordance with an embodiment of the present invention.

As illustrated in FIG. 9, the toner supplying container 102 has a cylindrical shape, and is so supported by the supporting member 105 that the toner supplying container 102 can rotate around a rotational axis L. The toner supplying container 102, together with the supporting member 105, is attached in a detachable manner to the toner supply container storing section 103 (FIG. 14) of the image forming apparatus 101. When the toner in the toner supplying container 102 is consumed, a new toner supplying container 102 is attached to the image forming apparatus 101, so as to supply the toner.

As illustrated in FIG. 15, the toner supplying container 102 to be attached to the image forming apparatus 101 is inserted into the image forming apparatus 101, in the direction indicated by arrow A, and is connected to the main-body-side connecting section 180 provided on the image forming apparatus 101. The main-body-side connecting section 180 connects the toner supplying container 102, and transmits, to the toner supplying container 102, a driving force of a drive-source 185, such as a motor, of the image forming apparatus 101, thereby causing the rotation of the toner supplying container 102. Accordingly, as illustrated in FIG. 15 and FIG. 16, the main-body-side connecting section 180 includes: a connector receiving section 181 to which the toner supplying container 102 is connected; a spring 183 such as a helical compression spring; a driving force receiving section 187 for receiving the driving force transmitted from the drive-source 185, such as a motor, of the image forming apparatus 101; and a rotation axis 184 for connecting the connector receiving section 181 and the driving force receiving section 187 through a casing 188 of the image forming apparatus 101.

The connector receiving section 181 has a disk-like shape, and is rotated by the driving force transmitted from the drive-source 185, so as to cause the toner supplying container 102 to rotate around the rotational axis L (FIG. 9) of the toner supplying container 102. Accordingly, the connector receiving section 181 is mounted so that its center of rotation coincide with the center of rotation of the rotation axis 184 penetrating the casing 188 of the image forming apparatus 101. Further, the toner supplying container 102 is connected to the connector receiving section 181 so that the rotation center of the rotation axis 184 coincide with the rotational axis L of the toner supplying container 102.

Further, the connector receiving section 181 includes: connector-side projections 182 for connecting the toner-supplying container 102; and a connector-side receiving section 189.

To the rotation axis 184, the spring 183 such as a helical compression spring is mounted. This spring 183 pushes the connector receiving section 181 in a direction away from the casing 188. Thus, at the time of mounting the toner supplying container 102 to the image forming apparatus 101, a regulating member (not shown) regulates a movement of the toner supplying container 102 in the mounting direction so that the toner supplying container 102 pushes the connector receiving section 181.

Further, the driving force from the drive-source 185 is transmitted to the driving force receiving section 187, via the reduction device 186 such as a gear or the like. The driving force receiving section 187 transmits the driving force to the connector receiving section 181, via the rotation axis 184.

Thus, when the toner supplying container 102 is mounted to the image forming apparatus 101, the driving force from the drive-source 185 of the image forming apparatus 101 is transmitted to the connector receiving section 181, via the deceleration device 186 and the rotation axis 184. This causes the rotation of the connector receiving section 181, which consequently causes the rotation of the toner supplying container 102 around the rotational axis L.

As illustrated in FIGS. 7(*a*) and 7(*b*), the toner supplying container 102 includes: a first container 151 and a second container 152, each including a bottom surface of the toner supplying container 102; and a third container 153 provided between the first container 151 and the second container 152 and supported by the supporting member 105. The first container 151, the second container 152 and the third container 153 are integrally formed through a blow molding process or the like, by using synthetic resin such as polyethylene.

The first container 151 is located on a side of the cylindrical toner supplying container 102, the side to be connected to the main-body-side connecting section 180 (FIG. 15) of the image forming apparatus 101. This first container 151 receives the driving force transmitted from the drive-source 185 of the image forming apparatus 101. Accordingly, as illustrated in FIG. 7(*a*), an end portion of the first container 151; i.e., a bottom portion of the toner supplying container 102, is provided with: projections 154 projecting from the bottom portion of the toner supplying container 102, the projections 154 serving as a connector for connecting the toner supplying container 102 with the main-body-side connecting section 180 (described later) of the image forming apparatus 101; and a supply-lid 155 provided, in a detachable manner, to the toner supplying opening from which the toner is supplied to the toner supplying container 102.

For example, as illustrated in FIG. 15, the connector receiving section 181 of the main-body-side connecting section 180 and the toner supplying container 102 are connected as follows. Namely, the projections 154 provided on the first container 151 of the toner supplying container 102 are engaged with the connector-side projections 182 provided to the connector receiving section 181, and the supply-lid 155 is engaged with the connector-side receiving section 189 provided on the connector receiving section 181.

On the contrary, as illustrated in FIG. 7(*a*), the second container 152 is provided on an end of the toner supplying container 102, opposite to the side connected to the image forming apparatus 101.

The first container 151 and the second container 152 are respectively provided with conveying sections 156*a* and 156*b* on their internal surfaces. With the conveying sections 156*a* and 156*b*, toner is conveyed from the respective end portions (bottom portions) of the toner supplying container 102 towards the third container 153 located in the middle portion of the toner supplying container 102, along with the rotation of the toner supplying container 102. The conveying section 156*a* of the first container 151 and the conveying section 156*b* of the second container 152 are symmetrical to each other with respect to the third container 153 (supporting member 105), and are tilted at a predetermined angle with respect to a direction perpendicular to the rotational axis L of the toner supplying container 102.

Figure 17:
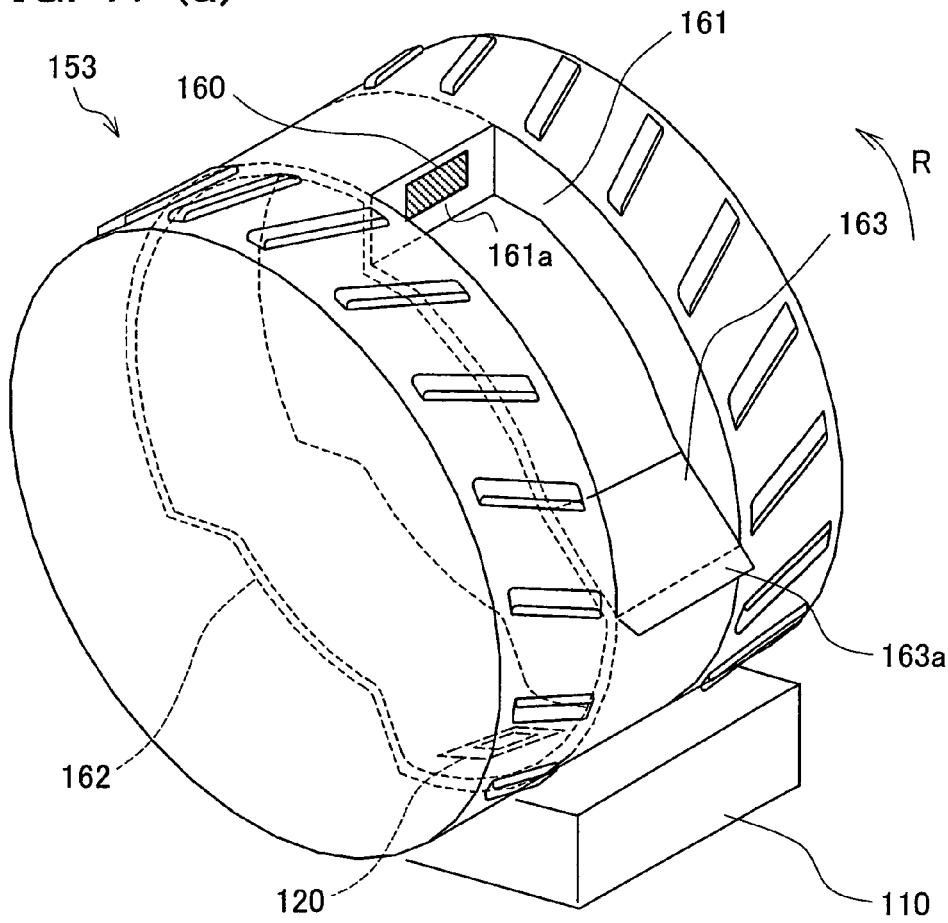
FIG. 17(*a*) is a perspective view illustrating the third container of the toner supplying container illustrated I FIG. 9, and FIG. 17(*b*) is a cross sectional view illustrating a scraper provided to a first depressed portion of the third container.
Figure 17:
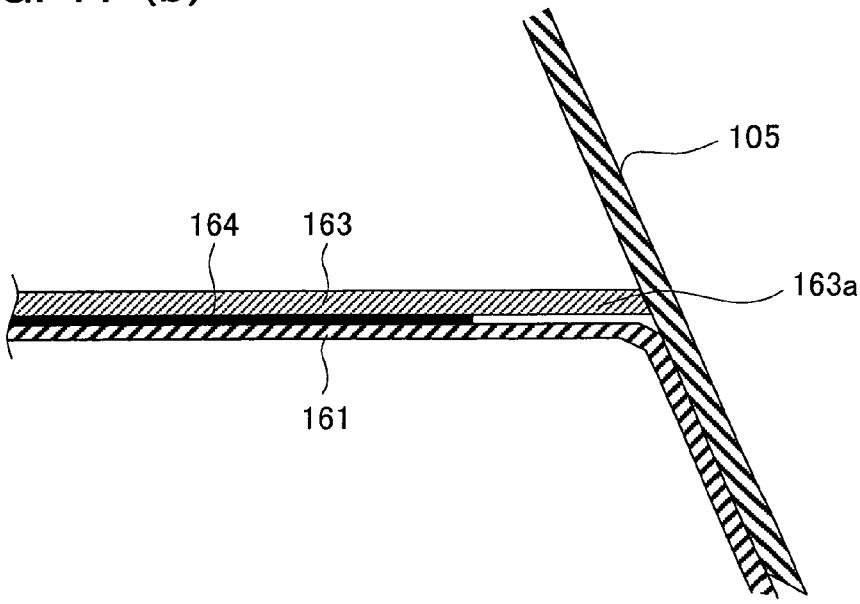

FIG. 17(*a*) is a perspective view of the third container 153, and FIG. 17(*b*) is a cross sectional view illustrating a main part of the third container 153. Further, FIG. 18(*a*) through FIG. 18(*c*) are cross sectional views of the third container 153.

As illustrated in FIG. 7(*a*), the third container 153 is located between the first container 151 and the second container 152, and is supported by the supporting member 105. The supporting member 105 is provided with a supplying-path 106 (details are described later) which supplies, to a subsequent stage, the toner stored in the toner supplying container 102. Further, as illustrated in FIG. 17(*a*) and FIG. 18(*a*), the third container 153 is provided, on its outer peripheral surface, with a toner-supplying opening 160 for supplying toner from the toner supplying container 102 to the supplying-path 106.

Figure 18:
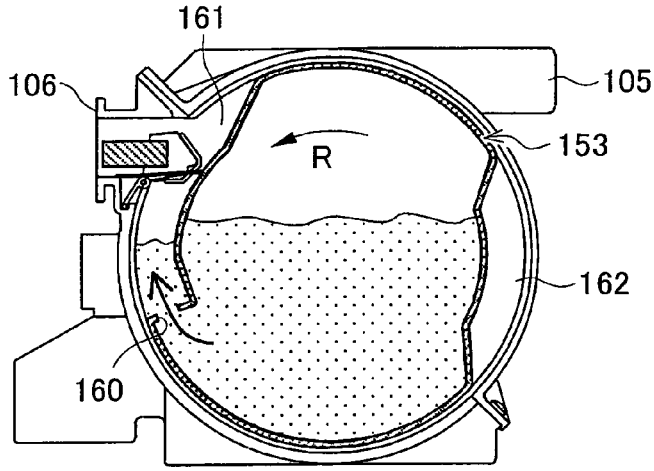
FIG. 18(*a*) is a diagram illustrating a situation where the toner flows into the first depressed portion of the third container illustrated in FIG. 17(*b*), FIG. 18(*b*) is a diagram illustrating a situation where the toner is held in the first depressed portion, and FIG. 18(*c*) is a diagram illustrating a situation where the toner is delivered from the first depressed portion.
Figure 18:
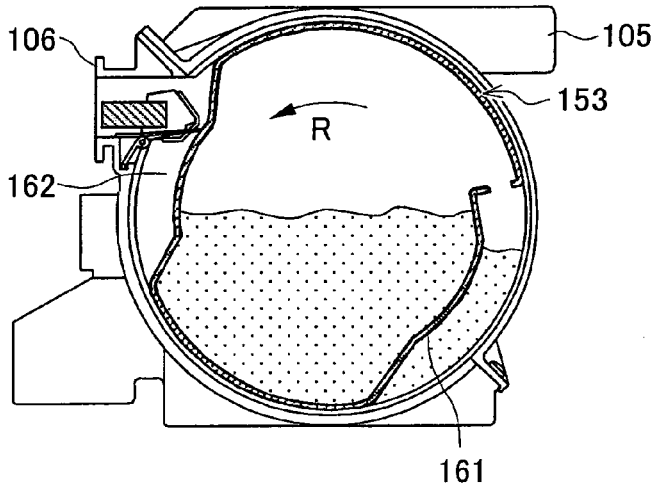
Figure 18:
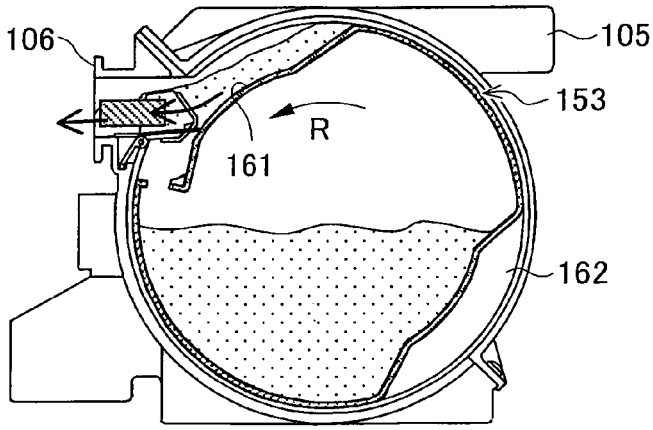

Further, as illustrated in FIG. 17(*a*) and FIG. 18(*a*) through FIG. 18(*c*), the third container 153 has on its outer peripheral surface a first depressed portion 161 and a second depressed portion 162, each of which having a depressed shape. The first depressed portion 161 and the second depressed portion 162 are symmetrical to each other with respect to the rotation axis, and are arranged apart from each other by a predetermined distance.

As described, the above described toner supplying container 102 is rotatably supported by the supporting member 105, at the third container 153 (FIG. 9). The first depressed portion 161 and the second depressed portion 162 are depressed portions provided on the outer peripheral surface of the third container 153. As such, the contact region of the third container 153 with respect to the supporting member 105 can be reduced, during the rotation of the toner supplying container 102. This reduces the friction between the supporting member 105 and the toner supplying container 102 during the rotation of the toner supplying container 102, thus realizing a smooth rotation of the toner supplying container 102.

Further, as illustrated in FIG. 7(*a*), since the third container 153 is supported by the supporting member 105, the supporting member 105 covers the top (open portion) of the first depressed portion 161 or the second depressed portion 162. In other words, as illustrated in FIG. 7(*b*), in portions of the toner supplying container 102 where the first depressed portion 161 and the second depressed portion 162 are formed, there is a space surrounded by the outer peripheral surface of the container 153 and the supporting member 105.

Here, the space formed by the first depressed portion 161 and the supporting member 105 is used for (I) holding the toner ejected from the toner supplying container 102, and (II) feeding the toner to the supplying path 106 (See FIG. 18(*a*)) of the supporting member 105. More specifically, as illustrated in FIG. 17(*a*), the first depressed portion 161 has the toner-supplying opening 160 at a wall 161*a* provided on a downstream side of a rotating direction R of the toner supplying container 102. Accordingly, as illustrated in FIG. 18(*a*), when the toner-supplying opening 160 reaches the surface of the toner (shaded portion in the figure) in the toner supplying container 102 during the rotation of the toner supplying container 102 in the rotating direction R, the toner stored in the toner supplying container 102 flows into the first depressed portion 161 from the toner-supplying opening 160. The first depressed portion 161 moves along with the rotation of the toner supplying container 102. Thus, as the toner supplying container 102 rotates with the toner which has been ejected into the first depressed portion 161, the toner is fed to the supplying path 106 of the supporting member 105, as illustrated in FIG. 18(*b*) and FIG. 18(*c*).

Further, as illustrated in FIG. 17(*a*), the first depressed portion 161 includes a scraper 163. As illustrated in FIG. 17(*a*), the scraper 163 is provided on an end of the first depressed portion 161, opposite the toner-supplying opening 160. That is, the scraper 163 is provided on the upstream side in the rotating direction R of the toner supplying container 102. The scraper 163 is so provided that its leading portion 163*a* projects from the outer peripheral surface of the third container 153. Accordingly, as illustrated in FIG. 17(*b*), the leading portion 163*a* contacts the internal surface of the supporting member 105.

The scraper 163 is formed of a base film which is made of polyester or the like. As illustrated in FIG. 17(*b*), the scraper 163 is attached to the first depressed portion 161, except for the leading portion 163*a*, by using an adhesive agent 164. Thus, the leading portion 163*a* can bend in accordance with the positional relationship between the toner supplying container 102 and the supporting member 105. This allows for the rotation of the toner supplying container 102, with the leading portion 163*a* of the scraper 163 always sliding on the inner surface of the supporting member 105.

Thus, during the rotation of the toner supplying container 102, the scraper 163 slides along the inner surface of the supporting member 105, so as to feed the toner into the first depressed portion 161. As a result, as illustrated in FIG. 18(*a*) through FIG. 18(*c*), even if the first depressed portion 161 changes its position along with the rotation of the toner supplying container 102, the toner supplying container 102 can hold the toner in the first depressed portion 161 during its rotation.

Further, the toner is generally a microscopic substance having a particle diameter ranging from several μm to several tens of μm. Accordingly, during the rotation of the toner supplying container 102, the toner may enter between (I) the outer peripheral surface of the third container 153, provided between the first depressed portion 161 and the second depressed portion 162 and (II) the inner surface of the supporting member 105. However, with the provision of the scraper 163, the scraper 163 feeds the toner toward the first depressed portion 161 so that the toner is held within the first depressed portion 161, even if the position of the first depressed portion 161 is changed due to the rotation of the toner supplying container 102. This prevents the toner from entering between (I) the peripheral surface of the third container 153, provided between the first depressed portion 161 and the second depressed portion 162 and (II) the internal surface of the supporting member 105.

Unlike the first depressed portion 161, the second depressed portion 162 has no toner-supplying opening for ejecting the toner, as illustrated in FIG. 17(*a*). Accordingly, the toner is not ejected to the second depressed portion 162.

Further, as illustrated in FIG. 17(*a*), in the present embodiment, the IC-tag 120 is provided on the third container 153, and the communication device 110 is so arranged that the communication device 110 faces the third container 153. In general, it is typically preferable that the rotation stopping position of the toner supplying container 102 be set so that the toner-supplying opening 160 is positioned at the top, as illustrated in FIG. 7(*b*). As already described with reference to FIG. 18(*a*) through FIG. 18(*c*), this is because such a rotation stopping position allows the toner supplying container 102 to (I) hold the toner in the first depressed portion 161 of the third container 153, and (II) supply the toner to the supplying path 106 of the supporting member 105.

In short, with the toner supplying container 102, the toner can be stably supplied into the supplying path 106 of the supporting member 105, along with the rotation of the toner supplying container 102. In order to realize the stable supply of the toner, it is necessary to control the rotation stopping position of the toner supplying container 102.

More specifically, the rotation of the toner supplying container 102 is stopped at such a position that the toner flows into the first depressed portion 161 through the toner-supplying opening 160. If the toner supplying container 102 is left at this position for a long time, the toner may be hardened within the first depressed portion 161, due to the pressure exerted by the weight of the toner. In this case, the toner remains in the first depressed portion 161 even when the rotation of the toner supplying container 102 is resumed for supplying the toner. This causes difficulties in realizing the stable supply of the toner. In view of the problem, it is preferred to control the rotation stopping position of the toner supplying container 102 so that the toner does not flow in through the toner-supplying opening 160 while the rotation of the toner supplying container 102 is stopped. Accordingly, in general, the toner supplying container 102 is mounted to the image forming apparatus 101 in such a manner that the toner-supplying opening 160 is positioned at the top, as illustrated in FIG. 7(*b*). Further, in general, the rotation of the toner supplying container 102 is stopped so that the toner-supplying opening 160 is positioned at the top.

As described, the toner supplying container 102 is mounted to the image forming apparatus 101 so that the toner-supplying opening 160 is positioned at the top, as illustrated in FIG. 7(*b*). Further, immediately after the toner supplying container 102 is mounted to the image forming apparatus 101, the IC-tag 120 and the communication device 110 preferably perform an information communication concerning managing information of the toner supplying container 102. Accordingly, as illustrated in FIG. 17(*a*), with the toner-supplying opening 160 is positioned at the top, the IC-tag 120 is preferably positioned such that the distance between the IC-tag 120 and the communication device 110 is the shortest. In other words, the IC-tag 120 is preferably positioned opposite the toner-supplying opening 160, with the rotational axis L in between.

Next described is the supporting member 105 which supports the toner supplying container 102. As illustrated in FIG. 7(*b*), the supporting member 105 is provided with the supplying path 106 with which the toner ejected from the toner supplying container 102 is supplied to the intermediate hopper 131. The supplying path 106 faces the intermediate hopper 131. Further, when the toner-supplying container 102 is mounted to the image forming apparatus 101, the supplying path 106 is positioned above the rotation axis of the toner supplying container 102, as illustrated in FIG. 7(*b*).

Further, as illustrated in FIG. 9 and FIG. 15, the supporting member 105 includes a shutter 109 which opens/closes the supplying path 106. While the toner supplying container 102 is mounted to the image forming apparatus 101, the shutter 109 is opened, and is closed otherwise. More specifically, when the toner supplying container 102 along with the supporting member 105 are inserted into the toner supply container storing section 103 of the image forming apparatus 101 in the direction indicated by the arrow A of FIG. 15, the shutter 109 slides in a direction parallel to the inserting direction. When the toner supplying container 102 is completely mounted, the shutter 109 is opened. With the shutter 109 opened, the toner can be supplied through the supplying path 106 to the intermediate hopper 131. On the other hand, when the toner supplying container 102 is detached from the image forming apparatus 101, the shutter 109 slides and is closes so as to block the supplying path 106. As described, since the shutter 109 blocks the supplying path 106, a leakage of the toner from the toner supplying container 102 can be prevented.

Figure 19:
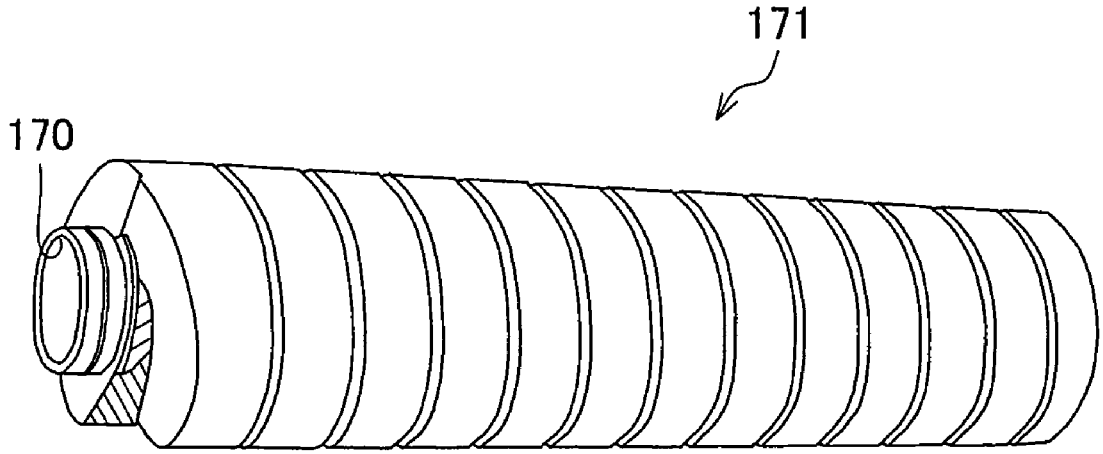
FIG. 19 is a perspective view illustrating an alternative form of the toner supplying container in accordance with another embodiment of the present invention.
Figure 20:
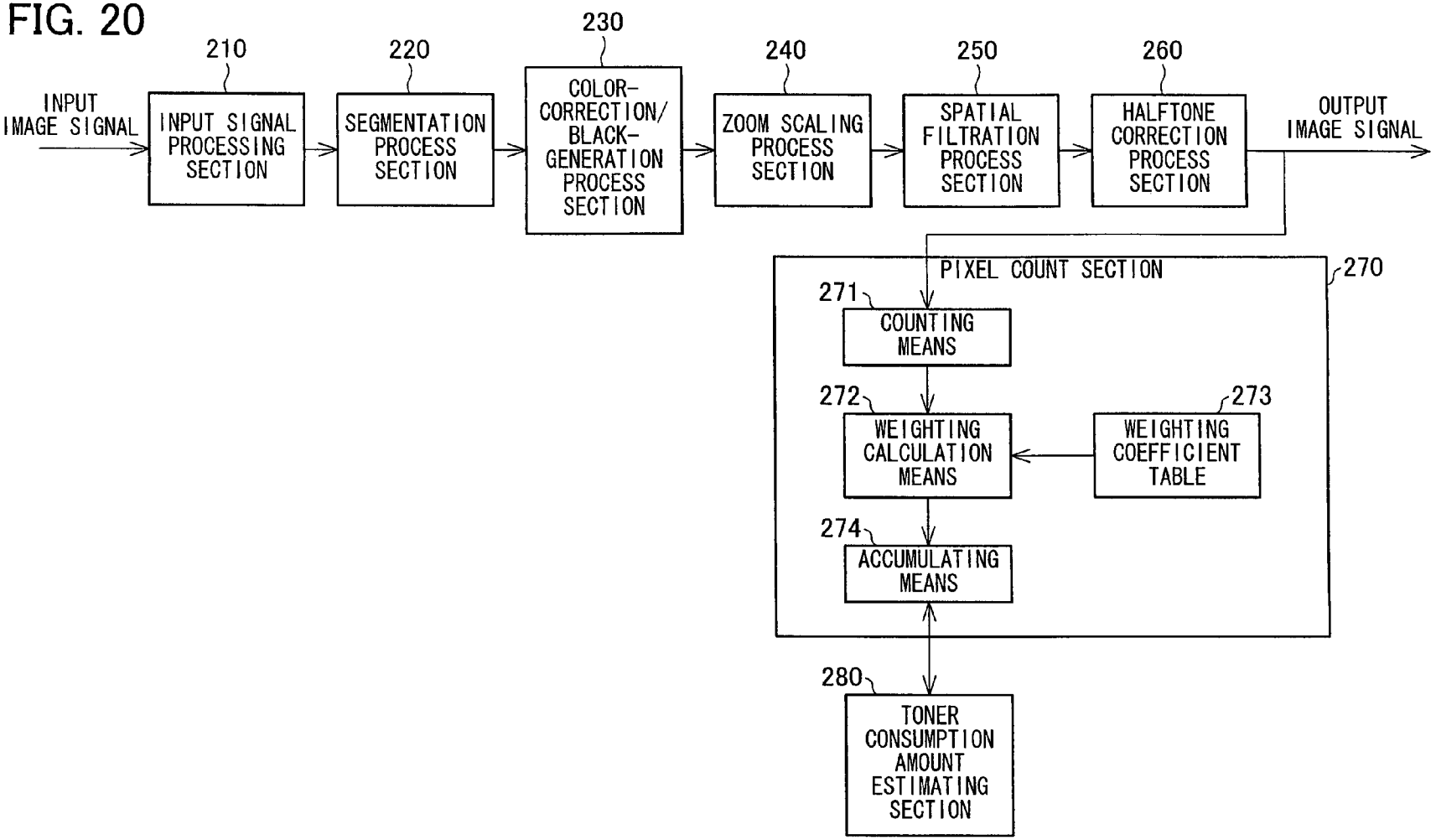
FIG. 20 is a block diagram illustrating a configuration of a main part of a conventional image forming apparatus.
Figure 21:
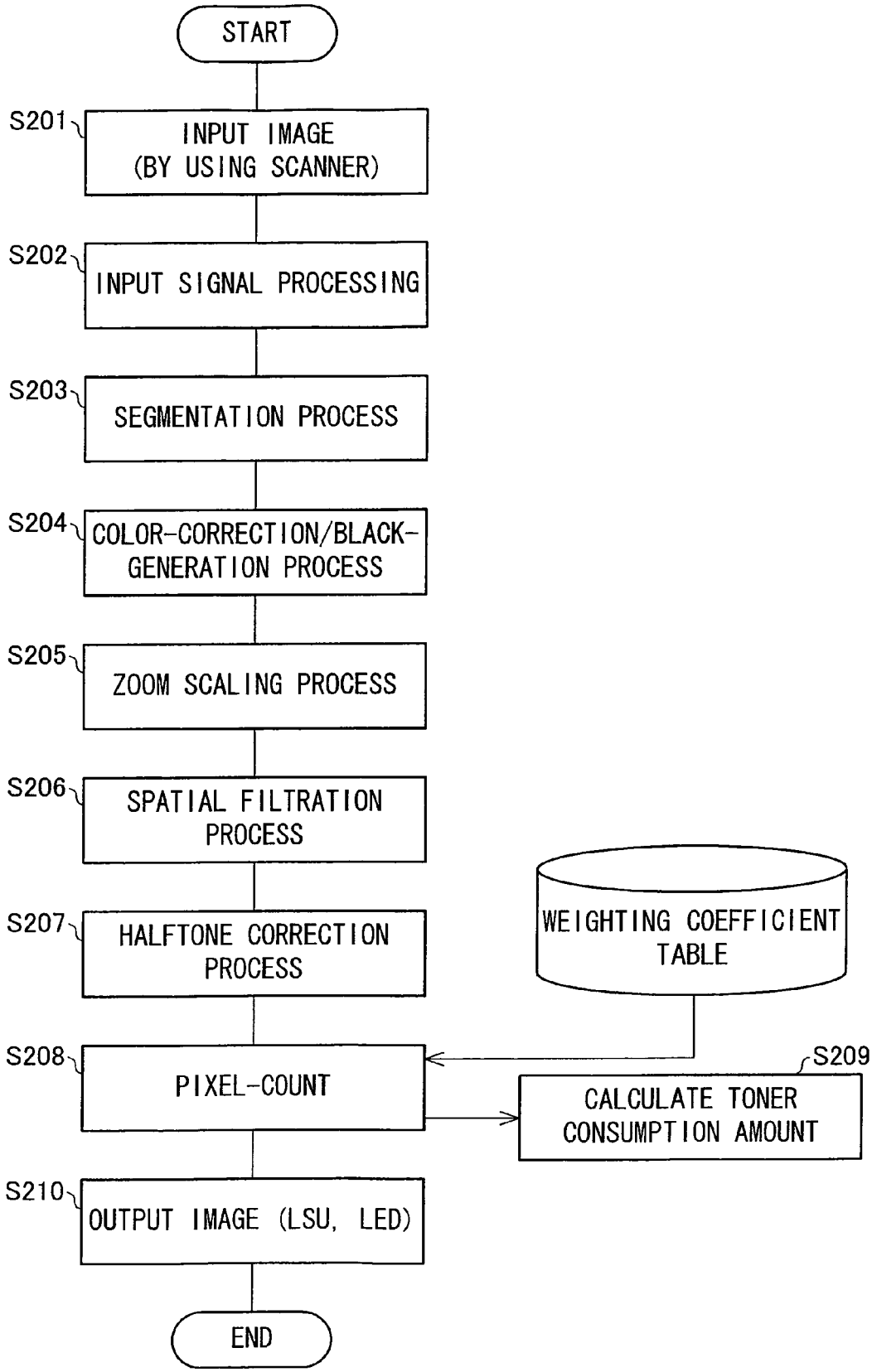
FIG. 21 is a flowchart illustrating a flow of an image processing in the image forming apparatus illustrated in FIG. 20.
Figure 22:
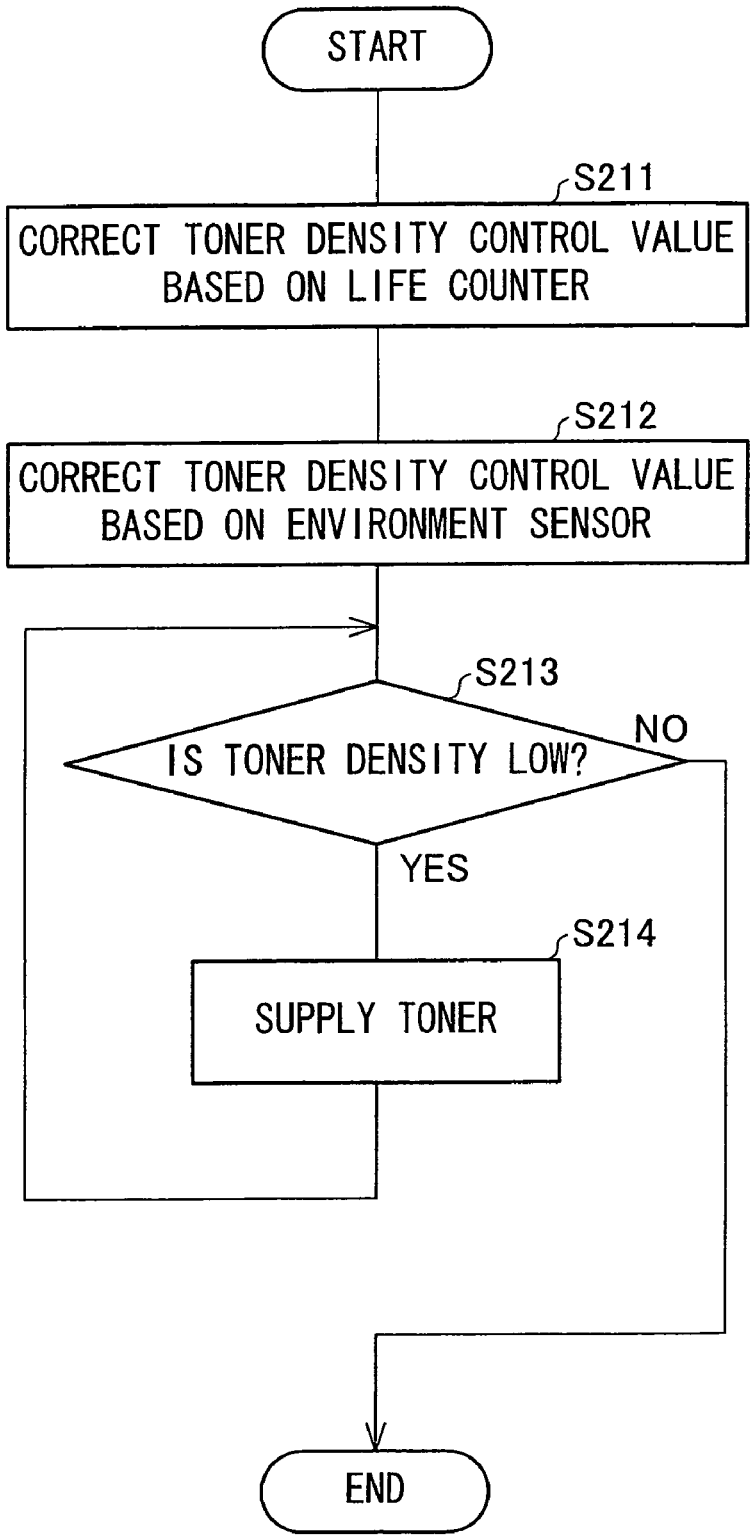
FIG. 22 is a flow chart illustrating a flow of a toner density controlling process.

Note that the present embodiment deals with a case where the toner supplying container 102 includes the third container 153 having the toner-supplying opening 160 as illustrated in FIG. 7(*b*). However, the present invention is not limited to this. That is, as illustrated in FIG. 19, it is possible to (I) adopt a toner supplying container 171 having, on its end portion, a toner-supplying opening 170, and (II) attach the IC-tag to the toner supplying container 171.

Further, the position of the IC tag to be attached to the toner supplying container is not particularly limited as long as the IC tag changes its position along with the rotation of the toner supplying container. Accordingly, as illustrated in FIG. 17(*a*), the position of the IC tag is not limited to the peripheral surface of the third container of the toner supplying container 102, and the IC tag may be provided on the first container 151 or the second container 152.

However, in order to more accurately detect the amount of the toner in the toner supplying container, it is preferable that the IC tag be provided in the vicinity of the toner-supplying opening from which the toner is ejected. In other words, it is preferable that the antenna section and the communication-side antenna be provided so that the IC tag and the communication device are able to carry out a communication via the toner remaining at or in the vicinity of the toner-supplying opening.

More specifically, as illustrated in FIG. 17(*a*), the IC tag 120 is preferably provided on the peripheral surface of the third container 153 including the toner-supplying opening 160. Further, in the case of the toner supplying container 171 illustrated in FIG. 19, the IC tag is preferably provided nearby the toner-supplying opening 170. Since the toner is fed to the toner supplying aperture, it is possible to accurately detect the amount of the toner, even if little amount of the toner is left in the toner supplying container.

Further, the present embodiment deals with the case where the rotating device is the toner supplying container. However, the rotating device is not particularly limited as long as the rotating device is a member which rotates in the image forming apparatus 101. For example, the rotating device may be: photosensitive drum 133; the agitator 140 or the toner-supplying roller 141 provided to the intermediate hopper 131; a developing roller or the like in the developing device 132, which are illustrated in FIG. 14. In a case where the IC tag is attached to the agitator 140, the toner-supplying roller 141, the developing roller, or the like, it is possible to detect the amount of the toner in the developing device 132 or the amount of the toner in the intermediate hopper 131.

As described, the main control device 104 (FIG. 8) monitors the reception strength or changes in the reception strength of the communication device 110. This enables the main control device 104 (FIG. 8) to detect the amount of the toner in the toner supplying container 102, i.e., to detect the toner supply container storing section 103. Accordingly, the main control device 104 may be used as a device for detecting a remaining amount of the toner in the toner supply container storing section 103.

Note that the toner may be: a non-magnetic toner which is used in a single component development or in a two component development; a magnetic toner; or a two component developer including the toner and a carrier.

Further, it is possible to detect not only the amount of the toner, but also an amount of ink or the like contained in an ink cartridge for use in an inkjet printer.

As illustrated in FIG. 14, with the configuration described above, a constant amount of the toner is supplied through the supplying path 106 to the intermediate hopper 131, and by counting the total number of rotations of the toner-container, it is possible to accurately detect the toner supply amount.

The toner consumption amount may not significantly differ each time the toner consumption amount is calculated based on the pixel-count value. However, if the error is accumulated, the total error becomes significant. In order to solve the problem, the pixel-count value is corrected by using the actual amount of the toner having been supplied. The toner is supplied when the toner is consumed and its density has been decreased. If the amount of the toner supply amount is constant, counting the number of the toner-supplying operations allows for detection of the amount of the toner actually having been consumed. Then, the pixel-count value is corrected based on the actual toner consumption amount. For example, where the pixel count process is carried out after 1000 copies are made, the difference between the toner consumption amount calculated based on the pixel-count value and the actual toner consumption amount adds up to a significant error. In view of that, at the time of supplying the toner, the toner supply amount is detected by using the toner supply amount detecting section 91. Then, the toner consumption amount can be calculated based on the toner supply amount detected. Accordingly, the actual toner consumption amount S is compared with a value S' of the toner consumption amount calculated based on the pixel-count value. Where S=15, and S'=12, the ratio is: $\alpha=S/S'=1.25$. The weighting coefficient is multiplied by the coefficient a, and the pixel-count value is re-calculated, thus correcting the totaled pixel-count value. This allows for the calculation of the total pixel-count value without a significant difference in the toner consumption amount.

An image forming apparatus of the present embodiment is an image forming apparatus which (I) digitally carries out an image processing and a correction process with respect to image information, and (II) carries out an image formation by using toner supplied at a constant ratio to a developer tank, the image forming apparatus including: toner supply amount detecting means for detecting a toner supply amount to the developer tank; pixel value calculating means for detecting a pixel value (signal value) of each pixel constituting a multi-valued image inputted; toner consumption amount estimating means for estimating a toner consumption amount based on the pixel value detected; and pixel value correcting means for correcting, in accordance with the toner supply amount, the pixel value detected by the pixel value calculating means, the toner supply amount detected by the toner supply amount measuring section.

As described, the toner consumption characteristic varies amongst various models, or varies due to aging, using environment, or the like. Estimation of the toner consumption amount based on the pixel value causes an error between the toner consumption amount estimated and the actual toner consumption amount. This error tends to become more significant, as the number of image forming operations performed in the image forming apparatus increases.

In view of that problem, since the toner supply amount to the developer tank and the toner consumption amount in the developer tank are substantially the same, the pixel amount is corrected based on the toner supply amount. In this way, the toner consumption amount estimated becomes closer to the actual consumption amount, when compared to the case of estimating the toner consumption amount based on a uncorrected pixel value.

Thus, the toner consumption amount can be always calculated accurately, even if the toner consumption characteristic varies amongst various models, or due to aging, using environment, or the like.

A specific configuration of the pixel value calculating means is as follows. Namely, the pixel value calculating means includes: a weighting coefficient table storing therein a weighting coefficient associated with an input signal value; counting means for carrying out a counting process for finding out the input signal value of each pixel constituting a multi-valued image inputted; weighting calculating means for (I) acquiring the weighting coefficient associated with the input signal value, while the counting means is carrying out the counting process to find out the input signal value, and (II) carrying out the weighting process with respect to each pixel. The pixel value having been subjected to the weighting process by the weighting calculating means is outputted to the toner consumption amount estimating means. In this case, the pixel value correcting means corrects the weighting coefficient table, in accordance with the toner supply amount detected by the toner supply amount detecting means.

For example, when the toner supply amount is found based on the number of toner supplying operations, $S=a \cdot N$, where: N is a toner supply amount; a is the toner supply amount per operation; and S is an accumulated toner supply amount. Then, where S' is the toner consumption amount found based on the pixel-count value, $S/S'=\alpha$. By multiplying the weighting coefficient table by this coefficient $\alpha$, it is possible to approximate the toner consumption amount to the actual toner consumption amount.

Thus, the toner consumption amount can be always calculated accurately, even if the toner consumption characteristic varies amongst various models, or varies due to aging, using environment, or the like.

Further, the toner supply amount may also be found as follows.

Namely, it is possible to provide a toner supplying section including a rotating member which rotates to supply the toner to the developer tank, and the toner supply amount detecting means may detect the toner supply amount based on a rotation number of the rotating member.

Alternatively, it is possible to provide a toner supplying section including a rotating member which rotates to supply the toner to the developer tank, and the toner supply amount detecting means may detect the toner supply amount based on a total rotation period of the rotating member.

These configurations realizes a simple configuration which allows an accurate detection of the toner supply amount.

The pixel value correcting means may correct the pixel value, every time the toner supply amount reaches a predetermined amount, the toner supply amount being detected by the toner supply amount detecting means.

This is for absorbing the error in the amount of the toner supplied each time. More specifically, it is extremely difficult to accurately supply, by each rotation, the constant amount of the toner. However, since the amount of the toner which is supplied by a certain number of rotations such as 100 rotations or 500 rotations is substantially constant, the toner consumption amount can be accurately estimated, by correcting the signal values every time the toner supply amount reaches the amount supplied by the certain number of rotations.

Further, it is possible to provide a toner remaining amount detecting means for detecting a toner remaining amount in a toner supplying section, and the pixel value correcting means may not correct the pixel value, while the toner remaining amount detected by the toner remaining amount detecting means is determined to be equal to or less than a predetermined amount.

In short, the correction of the pixel value is not carried out after the toner remaining amount reaches a toner near-end which means that little toner is left.

As described, after the toner remaining amount reaches the toner near-end, the toner supply amount becomes inconstant. The correction of the pixel value based on the toner supply amount at this time may result in a reverse effect of increasing the error. On this account, after the toner remaining amount reaches the toner near-end, the pixel value is not corrected based on the toner supply amount. Thus, the toner consumption amount is estimated based on the pixel value which is accurately corrected before the toner remaining amount reaches the toner near-end, and which is not corrected after the toner remaining amount reaches the toner near-end. This allows a consistent estimation of the toner consumption amount with little error.

Further, more preferably, the image forming apparatus may have the following configuration including a developer tank and the toner supplying device.

Namely, the image forming apparatus may further include: a rotating device which rotates to supply the toner to the developer tank, the rotating device including a communicating element; a communication device for performing, via a contactless communication element, an information communication with the communicating element; and a rotation angle detecting section for detecting a rotation angle of the rotating device, by detecting a communication status of the information communication performed between the communicating element and the communication device.

Here, the rotation angle detecting section detects the rotation angle of the rotating device, based on a variation in reception strength of a communication wave used in the information communication.

In the above configuration, the communicating element is attached to the rotating device. Accordingly, relative positions of the communicating element and the communicating device vary along with the rotation of the rotating device. This causes a variation in the communication status of the information communication performed between the communicating element and the communicating device. More specifically, the variation occurs in a reception strength for receiving a communication wave for use in the information communication.

In view of that, in the image forming apparatus, the rotation angle detecting section detects the variation in the communication status of the information communication performed between the communicating element and the communicating device; e.g., the variation in the reception strength for receiving the communication wave, so as to obtain information regarding the rotation angle of the rotating device. In other words, with the above configuration, the rotation angle of the rotating device can be detected by using the communicating element and the communicating device, which perform the information communication via a contactless communication element, for detecting the variation in the communication status between the communicating element and the communicating device.

Accordingly, with the configuration, the communicating element and the communicating device can be used not only for performing the information communication, but also for detecting the rotation angle of the rotating device. This is advantageous in simplifying the configuration of the image forming apparatus. As a result, it is possible to reduce the number of the parts in the image forming apparatus, and reduction of the cost becomes possible accordingly.

The image forming apparatus may be adapted so that the rotation angle detecting section detects a rotation amount of the rotating device.

Here, the rotation amount is, for example, a period of rotating the rotating device, or a drive-amount for use in driving the rotating device.

In the above configuration, the rotation angle detecting section detects the rotation amount of the rotating device. Accordingly, the rotation angle of the rotating device can be detected by detecting the rotating amount of the rotating device from the beginning of the rotation. Thus, it is possible to accurately detect the rotation angle of the rotating device, even if the communicating element and the communicating device is disabled to perform the information communication.

Further, the image forming apparatus may be adapted so that the communicating element includes (i) a storage section for storing managing information for the rotating device, and (ii) an antenna section.

In the configuration, the communicating element includes the storage section for storing therein the managing information. Accordingly, the image forming apparatus is able to read out or write the managing information from/into the storage section, by performing the information communication between the communicating element and the communicating device.

Further, the image forming apparatus may be adapted so that: the communication device includes a communicating section for performing the information communication with the antenna section of the communicating element; and the communicating section is arranged so as to face the antenna section at least once in each rotation of the rotating device.

In the above configuration, the rotation of the rotating device causes the antenna section and the communication section to face each other at least once. The antenna section and the communication section is able to perform a good communication when the antenna section and the communication section face each other. Accordingly, even in the case where the communicating element is provided to the rotating device, the communicating element and the communicating device are able to perform a good information communication such as the reading out or writing of the managing information from/in the storage section of the communicating element.

Further, the image forming apparatus is preferably adapted so that the antenna section and the communicating section are arranged so that, when the antenna section and the communicating section face each other, directivity of the antenna section and that of the communicating section coincide or are in parallel with each other.

In the above configuration, the antenna section and the communication section are arranged so that the directivity of the antenna section and that of the communication section coincide or are in parallel with each other. The antenna section and the communication section are able to perform a good information communication when the respective directivities coincide or are in parallel with each other. Accordingly, the antenna section and the communication section are arranged so that the antenna section and the communication section face each other, when the respective directivities coincide or are in parallel with each other. This realizes a highly reliable information communication. As a result, when the managing information is read out or written from/in the storage section, by performing a communication between the communicating device and the communication section, it is possible to realize an information communication which is excellent in an S/N ratio.

Further, the image forming apparatus may be adapted so that the rotating device stores therein predetermined content.

In the above case, it is preferable that the antenna section and the communication section be arranged so that the antenna section and the communication section face each other, at least once during one rotation of the rotating member, via the content in the rotating device.

In the configuration, the communication status of the information communication between the antenna section and the communication section varies due to an amount of the content in the rotating device as well. Accordingly, by performing the information communication between the antenna section and the communication section via the content, it is possible to detect the amount of the content in the rotating device.

Further, the image forming apparatus is preferably adapted so that: the content is the toner; and the rotating device is a developer supplying container for supplying the toner to the image forming apparatus.

In the configuration, the developer supplying container rotates in the image forming apparatus, so as to supply the toner. Accordingly, it is necessary to control the rotation stopping position and the rotation angle of the developer supplying container, in order to prevent the toner from (I) hardening or retained in the toner in the developer supplying container, or (II) leaking from the developer supplying container. The developer supplying container is therefore provided with the communicating element, and the rotation angle of the developer supplying container is detected, as described above. This allows the controlling of the rotation stopping position and the rotation angle of the developer supplying container.

Further, the toner is consumed as the image forming apparatus is operated. Accordingly, the toner remaining amount in the developer supplying container can be detected by using the communicating element and the communicating device.

Further, the image forming apparatus may be adapted so that the developer supplying container includes a developer supplying aperture for supplying the toner; the developer supplying container stops its rotation such that the developer supplying aperture is positioned at a predetermined position; and the antenna section and the communicating section face each other, when the developer supplying aperture is positioned at the predetermined position.

In the configuration, the developer supplying aperture is positioned at the predetermined position, when, for example, the developer supplying container is mounted to the image forming apparatus. The information communication is performed, between the communicating element and the communicating device, so as to acquire the managing information of the communicating element. In order to promptly acquire the managing information when the developer supplying container is mounted, in the above configuration, the antenna section and the communication section face each other when the developer supplying aperture is positioned at the predetermined position. This allows a prompt and highly reliable information communication between the communicating element and the communicating device.

Incidentally, the function of each means of the pixel count section 70 in the image processing device described in the above embodiment; i.e., the toner consumption amount estimating section 80, and the toner supply amount calculating section 90, is also realized by causing an arithmetic circuit such as a processor to execute a program, which is stored in storage means such as an ROM or RAM, for controlling various peripheral circuits or the like. Accordingly, simply by using a computer having the arithmetic circuit and the peripheral circuits or the like for (I) reading the program stored in a recording medium, and (II) executing the program, it is possible to realize the function and the process of each means of the pixel count section 70 in the image processing device described in the above embodiment; i.e., the toner consumption amount estimating section 80, and the toner supply amount calculating section 90. Further, the above described functions and processes are realized on an arbitrary computer, by storing the program in a removal recording medium.

Examples of such a recording medium are: (A) a tape-type recording medium such as electromagnetic tape, or a cassette tape; (B) a disc-type recording medium such as (i) an electromagnetic disc, e.g., Floppy® disc or a hard disc, and (ii) an optical disc, e.g., a CD-ROM, an MO (Magneto-Optical Disc), an MD (Mini Disc), a DVD (Digital Versatile Disk), CD-R, or the like; (C) a card-type recording medium such as (i) an IC card or a memory card and (ii) an optical card; (D) a semiconductor memory such as a mask ROM, an EPROM (Erasable Programmable Read-Only Memory), an EEPROM (Electrically Erasable and Programmable ROM), a flash ROM, or the like.

Further, the image processing device of the present embodiment may be so configured as to be connected to a communication network, so that the program can be supplied via the communication network. The communication network is not particularly limited. For example, the communication network may be the internet, an intranet, an extranet, a LAN (Local Area Network), an ISDN (Integrated Services Digital Network), a VAN (Value Added Network), a CATV communication network, a virtual private network, a telephone network, a mobile communication network, a satellite communication network, or the like. Further, a transmission medium used in the communication network is not particularly limited. For example, the program code may be supplied via a wired communication through IEEE1394, USB(Universal Serial Bus), an electric power line, a cable TV line, a telephone line, ADSL (Asymmetric Digital Subscriber Line), or the like. Alternatively, the program code may be supplied via a wireless communication. Examples of such a wireless communication are: an infrared wireless communication adopting IrDA; an infrared wireless communication used in a remote controller; a wireless communication adopting Bluetooth®; 802.11 wireless communication; HDR wireless communication; and a wireless communication via a mobile phone network, a satellite connection, a terrestrial digital network, or the like. Note that the present invention can be realized by using the program code in the form of a computer data signal superimposed on a carrier wave, the program code being transmitted through an electronic transmission.

The present invention is not limited to the embodiments above, but may be altered within the scope of the claims. An embodiment based on a proper combination of technical means disclosed in different embodiments is encompassed in the technical scope of the present invention.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. An image forming apparatus which forms, in accordance with an input signal, an image by using toner supplied to a developer tank from a toner supplying section, the image forming apparatus comprising:

toner supply amount detecting means for detecting an amount of toner supplied to the developer tank from the toner supplying section;

detecting means for detecting a signal value of each pixel of the image;

a storage section for storing therein a weighting coefficient table indicating a weighting coefficient corresponding to the signal value;

weighting process means for (i) acquiring, from the weighting coefficient table, the weighting coefficient corresponding to the signal value detected, and (ii) carrying out, by using the weighting coefficient acquired, a weighting process with respect to the signal value thus detected;

toner consumption amount estimating means for (i) accumulating the signal value which has been subjected to the weighting process, and (ii) estimating, in accordance with a value obtained by accumulating the signal value, an amount of toner that is consumed in the image forming apparatus; and correcting means for carrying out a correcting process of rewriting the weighting coefficient table in accordance with the amount of toner that is supplied as detected by the toner supply amount detecting means, wherein the correcting means carries out the correction process a plurality of times by the time an amount of toner remaining in the toner supplying section becomes a predetermined amount, and wherein the correcting means rewrites the weighting coefficient table in a current correction process in accordance with a cumulative amount of toner supplied between a previous correction process and the current correction process.

2. The image forming apparatus as set forth in claim 1, wherein the toner supplying section has a rotating member which rotates to supply the toner to the developer tank, and wherein the toner supply amount detecting means detects, in accordance with a number of rotations of the rotating member, the amount of toner that is supplied.

3. The image forming apparatus as set forth in claim 1, wherein the toner supplying section has a rotating member which rotates to supply the toner to the developer tank, and wherein the toner supply amount detecting means detects, in accordance with a total rotation period of the rotating member, the amount of toner that is supplied.

4. The image forming apparatus as set forth in claim 1, wherein the correcting means rewrites the weighting coefficient table every time the amount of toner that is supplied reaches a predetermined supplied amount.

5. The image forming apparatus as set forth in claim 1, further comprising:

toner remaining amount detecting means for detecting the amount of toner remaining in the toner supplying section, wherein the correcting means does not rewrite the weighting coefficient table while the amount of toner that remains is judged to be equal to or less than the predetermined amount.

6. The image forming apparatus as set forth in claim 1, further comprising:

a rotating device which rotates to supply the toner to the developer tank, the rotating device including a communicating element;

a communication device for performing, via a contactless communication element, an information communication with the communicating element;

a rotation angle detecting section for detecting a rotation angle of the rotating device, by detecting a communication status of the information communication performed between the communicating element and the communication device.

7. The image forming apparatus as set forth in claim 6, wherein the rotation angle detecting section detects the rotation angle of the rotating device, based on a variation in reception strength of a communication wave used in the information communication.

8. The image forming apparatus as set forth in claim 6, wherein the rotation angle detecting section further detects a rotation amount of the rotating device.

9. The image forming apparatus as set forth in claim 6, wherein the communicating element includes (i) a storage section for storing managing information for the rotating device, and (ii) an antenna section.

10. The image forming apparatus as set forth in claim 9, wherein the communication device includes a communicating section for performing the information communication with the antenna section of the communicating element; and the communicating section is arranged so as to face the antenna section at least once in each rotation of the rotating device.

11. The image forming apparatus as set forth in claim 10, wherein the antenna section and the communicating section are arranged so that, when the antenna section and the communicating section face each other, directivity of the antenna section and that of the communicating section coincide or are in parallel with each other.

12. The image forming apparatus as set forth in claim 11, wherein:

the rotating device stores therein predetermined content; and the antenna section and the communicating section face each other, at least once in each rotation of the rotating device, via the predetermined content in the rotating device.

13. The image forming apparatus as set forth in claim 6, wherein the rotating device stores therein predetermined content.

14. The image forming apparatus as set forth in claim 13, wherein:

the content is the toner; and the rotating device is a developer supplying container for supplying the toner to the image forming apparatus.

15. The image forming apparatus as set forth in claim 14, wherein:

the developer supplying container includes a developer supplying opening for supplying the toner;

the developer supplying container stops its rotation such that the developer supplying opening is positioned at a predetermined position; and the antenna section and the communicating section face each other, when the developer supplying opening is positioned at the predetermined position.

16. The image forming apparatus as set forth in claim 1, wherein the correcting means is arranged to rewrite the weighting coefficient table based on a toner consumption characteristic of the image forming apparatus, and wherein the toner consumption characteristics is determined based on optical sensor reading of a plurality of toner patches.

17. A method for estimating an amount of toner that is consumed in an image forming apparatus which forms, by using toner supplied to a developer tank from a toner supplying section, an image in accordance with an input signal, the method comprising:

detecting an amount of toner that is supplied to the developer tank from the toner supplying section;

detecting a signal value of each pixel of the image;

acquiring, from a weighting coefficient table storing therein weighting coefficients respectively corresponding to input values of the pixels, a weighting coefficient corresponding to the signal value detected;

carrying out, by using the weighting coefficient acquired, a weighting process with respect to the signal value thus detected;

accumulating the signal value which has been subjected to the weighting process;

estimating, in accordance with a value obtained by accumulating the signal value, an amount of toner that is consumed in the image forming apparatus; and carrying out a correction process of rewriting the weighting coefficient table in accordance with the amount of toner that is supplied as detected in the step of detecting the amount of toner that is supplied to the developer tank from the toner supplying section, wherein the step of carrying out the correction process of rewriting the weighting coefficient table in accordance with the amount Of toner that is supplied is performed a plurality of times by the time an amount of toner remaining in the toner supplying section becomes a predetermined amount, and wherein the step of carrying out the correction process of rewriting the weighting coefficient table in accordance with the amount of toner that is supplied rewrites the weighting coefficient table in a current correction process in accordance with a cumulative amount of toner supplied between a previous correction process and the current correction process.

18. The method as set forth in claim 17, further comprising:

reading light reflected from a plurality of toner patches; and rewriting the weighting coefficient table based on the reading.

19. A program for causing a computer to execute a process for estimating an amount of toner that is consumed in an image forming apparatus which forms, by using toner supplied to a developer tank from a toner supplying section, an image in accordance with an input signal, wherein the program causes the computer to execute:

(a) detecting an amount of toner that is supplied to the developer tank from the toner supplying section;

(b) detecting a signal value of each pixel of the image;

(c) acquiring, from a weighting coefficient table storing therein weighting coefficient respectively corresponding to input values of the pixels, a weighting coefficient corresponding to the signal value detected;

(d) carrying out, by using the weighting coefficient acquired, a weighting process with respect to the signal value thus detected;

(e) accumulating the signal value which has been subjected to the weighting process;

(f) estimating, in accordance with a value obtained by accumulating the signal value, an amount of toner that is consumed in the image forming apparatus; and (g) carrying out a correction process of rewriting the weighting coefficient table in accordance with the amount of toner that is supplied as detected in the step (a), wherein the step (g) is performed a plurality of times by the time an amount of toner remaining in the toner supplying section becomes a predetermined amount, and wherein the step (g) rewrites the weighting coefficient table in a current correction process in accordance with a cumulative amount of toner supplied between a previous correction process and the current correction process.

20. The program as set forth in claim 19, wherein the program further causes the computer to execute:

(h) reading light reflected from a plurality of toner patches; and (i) rewriting the weighting coefficient table based on the reading.

* * * * *